US007178573B2

(12) United States Patent
Tamai et al.

(10) Patent No.: US 7,178,573 B2
(45) **Date of Patent: *Feb. 20, 2007**

(54) MARK TRANSFER TOOL, MARK TRANSFER TAPE, AND MANUFACTURING METHOD OF MARK TRANSFER TAPE

(75) Inventors: Shigeru Tamai, Ikeda (JP); Masatoshi Shintani, Sanda (JP); Mikio Toyoda, Kawagoe (JP); Nobuyuki Motoyama, Fukaya (JP); Yoshiyuki Hori, Fukaya (JP); Goro Inoue, Fukaya (JP)

(73) Assignees: Seed Co., Ltd., Osaka (JP); Dynic Corporation, Kyoto (JP)

( * ) Notice: Subject to any disclaimer, the term of this patent is extended or adjusted under 35 U.S.C. 154(b) by 255 days.

This patent is subject to a terminal disclaimer.

(21) Appl. No.: 10/328,029

(22) Filed: Dec. 26, 2002

(65) Prior Publication Data

US 2003/0121613 A1 Jul. 3, 2003

(30) Foreign Application Priority Data

Dec. 27, 2001 (JP) ..... 2001-398599

(51) Int. Cl.
*B32B 37/00* (2006.01)

(52) U.S. Cl. ..... 156/541; 156/577; 156/579; 156/238; 118/76; 118/200; 118/256; 206/411; 242/160.2; 242/160.4; 242/170; 242/588.2; 242/588.3; 242/588.6

(58) Field of Classification Search ..... 156/574, 156/577, 579, 523, 527, 238, 538, 540; 118/76, 118/200, 257; 206/411; 242/170, 171, 588.2, 242/588.3, 588.6, 588, 160.2, 160.4
See application file for complete search history.

(56) References Cited

U.S. PATENT DOCUMENTS

| | | | | |
|---|---|---|---|---|
| 4,008,351 | A * | 2/1977 | Inoue et al. | 428/411.1 |
| 4,759,968 | A * | 7/1988 | Janssen | 428/202 |
| 5,397,763 | A * | 3/1995 | Fujimura et al. | 503/227 |
| 5,490,898 | A * | 2/1996 | Koyama | 156/540 |
| 5,507,908 | A * | 4/1996 | Fukushima et al. | 156/363 |
| 5,556,469 | A * | 9/1996 | Koyama et al. | 118/257 |
| 5,970,300 | A * | 10/1999 | Acquaviva | 399/341 |
| 6,601,631 | B1 * | 8/2003 | Miller et al. | 156/577 |
| 6,805,762 | B2 * | 10/2004 | Narita et al. | 156/86 |

* cited by examiner

*Primary Examiner*—Linda Gray
(74) *Attorney, Agent, or Firm*—Rader, Fishman & Grauer PLLC

(57) ABSTRACT

A mark transfer tool utilizing a coat film transfer technology, concerning various marks composed of characters, codes, patterns or their combination. A mark transfer tape has multiple pressure-sensitive adhesive transfer marks adhered and held at specified intervals peelably on the surface of a base tape, and the transfer marks are prepared as adhesive seals of which adhesive force of the back-side pressure sensitive adhesive layer adhered to the transfer area is set larger than the adhesive holding force on the base tape. Like adhesive seals, the transfer marks once transferred on the transfer area can be once peeled off and adhered again, or peeled and removed when no longer needed.

25 Claims, 29 Drawing Sheets

MARK TRANSFER TOOL, MARK TRANSFER TAPE, AND MANUFACTURING METHOD OF MARK TRANSFER TAPE

BACKGROUND OF THE INVENTION

1. Field of the Invention

The present invention relates to a mark transfer tool, a mark transfer tape and manufacturing method of mark transfer tape, and more particularly to a mark transfer technology for transferring a transfer mark in a thin film composed of characters, codes, patterns or their combination arranged and formed on a mark transfer tape, to a sheet of paper or the like.

2. Description of the Related Art

Generally, various marks composed of characters, codes, patterns or their combination are prepared as stamps and impressed on a sheet of paper or other object surface through ink, or prepared as mark seals (adhesive seals) and adhered to a sheet of paper or the like.

In the background of the recent technical innovation and diversification of general users' preferences, widening of product variety is needed in various technical fields, and such trend is not exceptional in the stationery field handling various marks.

SUMMARY OF THE INVENTION

It is hence an object of the invention to present novel mark transfer tool and mark transfer tape solving the problems of the prior art.

It is other object of the invention to present a novel mark transfer technology, completely different from the conventional mark utilizing technology, in various marks of characters, codes, patterns or their combination, by employing a coat film transfer technology.

It is another object of the invention to present a mark transfer tool effectively meeting diversified needs and preferences of general users, by employing a method of transferring a transfer mark on a mark transfer tape onto a sheet of paper or the like.

It is a further object of the invention to present a mark transfer tool, in which the transfer mark is composed of a mark and an overwriting blank space, so that letters can be overwritten by using a writing tool in the overwriting blank space after transfer of the transfer mark.

The mark transfer tool of the invention is a mark transfer tool for transferring a transfer mark on a mark transfer tape on a sheet of paper or the like, comprising a hand-held case, a payoff reel containing a mark transfer tape, being rotatably installed in the case, a take-up reel for collecting the used mark transfer tape, being rotatably installed in the case, and a transfer head having a leading end pressing portion for pressing the mark transfer tape being paid off from the payoff reel onto a transfer area, being disposed at the leading end of the case, in which the mark transfer tape has multiple pressure-sensitive adhesive transfer marks adhered and held at specific intervals peelably on the surface of a base tape, and the transfer marks are prepared as adhesive seals of which adhesive force of the back-side pressure sensitive adhesive layer adhered to the transfer area is set larger than the adhesive holding force on the base tape.

Preferably, the disposing intervals of the transfer marks on the transfer tape are set larger than the pressurizing width of the leading end pressing portion of the transfer head, and the step difference of the transfer marks and the base tape on the mark transfer tape should be set so that a transfer division position of one transfer mark may be shown by bodily or be felt bodily when the step difference is engaged with the leading end pressing portion of the transfer head, in the mark transfer operation, by composing division bodily feeling means in collaboration with the leading end pressing portion of the transfer head.

A basic configuration of the mark transfer tool is at least either a refill type in which a tape cartridge comprising the payoff reel and take-up reel is detachably installed in the case so as to be replaced and the mark transfer tape can be replaced, or disposable type in which the payoff reel and take-up reel are installed in the case, and the transfer head is provided at the leading end of the case.

A basic configuration of the transfer head is either elastic head or rigid head from the viewpoint of pressing force on the mark transfer tape, or any one of pointed head, wire head and cylindrical roller head from the viewpoint of pressuring structure on the mark transfer tape, which should be selected and employed depending on the transfer properties or applications of transfer marks.

The mark transfer tape of the invention is preferably installed and used in the mark transfer tool, multiple pressure-sensitive adhesive transfer marks adhered and held at specific intervals peelably on the surface of a base tape, and the transfer marks are prepared as adhesive seals of which adhesive force of the back-side pressure sensitive adhesive layer adhered to the transfer area is set larger than the adhesive force on the base tape.

Preferably, the transfer marks are formed in the following laminated structure.

i) The transfer mark is an integrally laminated form of a mark main body having a specified mark, and a pressure-sensitive adhesive layer, and this transfer mark is adhered and held on the surface of the base tape, peelably through the mark main body.

ii) The mark main body is an integrally laminated form of a surface layer made of a transparent material, and a mark layer forming a specified mark, and the pressure-sensitive adhesive layer is integrally laminated on the mark layer.

iii) The mark main body is an integrally laminated form of a mark layer forming a specified mark, and a surface layer forming a transfer mark surface, and the pressure-sensitive adhesive layer is integrally laminated on the surface layer.

iv) The mark main body is a single layer of coloring material, and its contour shape forms the contour shape of the transfer mark, and the pressure-sensitive adhesive layer is integrally laminated on the back side of the mark main body.

The base tape has a peelable layer formed on the back side, or has as peelable layer formed on the back side and a slight adhesive layer formed on the surface, depending on its constituent material.

The transfer mark is either composed of the mark alone, or composed of the mark and an overwriting blank space, and in the latter case the surface forming portion of the transfer mark is a material suited to overwriting by a writing tool, or the surface is treated so as to be overwritten by a writing tool.

The transfer mark is formed either as contact seal having the pressure-sensitive adhesive layer formed on the entire back side, or as index seal having the pressure-sensitive adhesive layer formed only in the longitudinal leading end portion of the back side. In the latter case, the adhesive force of the pressure-sensitive adhesive layer should be set so as to be transferred and fixed on the transfer area in ordinary state, and easily peeled from the transfer area.

Further, depending on the purpose, the transfer mark may be formed as an aromatic seal having an aromatic effect by containing an aromatic component in the constituent material, or an antibacterial seal having an antibacterial effect by containing an antibacterial component in the constituent material.

A first manufacturing method of mark transfer tape of the invention comprises a step of forming a mark main body having transfer marks and a pressure-sensitive adhesive layer sequentially to laminate on the entire surface of a base tape, a step of forming multiple cutting lines in specified transfer mark contour shape at specified intervals by die cutting means only on the laminated body of the mark main body and pressure-sensitive adhesive layer, and a step of forming transfer marks by peeling and removing the laminated body around the transfer mark contour shapes.

A second manufacturing method of mark transfer tape of the invention comprises a step of forming a pressure-sensitive adhesive layer having transfer marks and a mark main body sequentially to laminate on the entire surface of a base tape for die cutting, a step of forming multiple cutting lines in specified transfer mark contour shape at specified intervals by die cutting means only on the laminated layer of the mark main body and pressure-sensitive adhesive layer, a step of forming transfer marks by peeling and removing the laminated layers around the transfer mark contour shapes, and a step of laminating and forming these formed transfer marks on the surface of the base tape.

A third manufacturing method of mark transfer tape of the invention comprises a step of forming a pressure-sensitive adhesive layer having transfer marks and a mark main body sequentially to laminate on the entire surface of a base tape for die cutting, a step of forming multiple cutting lines in specified transfer mark contour shape at specified intervals by die cutting means only on the laminated layer of the mark main body and pressure-sensitive adhesive layer, a step of laminating and forming the die cut laminated layers on the surface of the base tape, and a step of forming transfer marks by peeling and removing the laminated layers around the transfer mark contour shapes.

A fourth manufacturing method of mark transfer tape of the invention is characterized by laminating and forming multiple transfer marks at specified intervals by printing the mark body having transfer marks and the pressure-sensitive adhesive layer sequentially on the surface of a base tape.

By the mark transfer tool of the invention, to transfer a transfer mark on the mark transfer tape in a desired transfer area on a sheet of paper, the case is gripped by fingers, the leading end pressing portion of the transfer head is tightly pressed on the transfer area, and the case is directly moved along the sheet of paper, so that the transfer mark is transferred, and the used mark transfer tape from which the transfer mark is peeled, that is, the base tape is taken up and collected on the take-up reel.

Such transferred transfer mark is an adhesive seal, and it can be handled same as a conventionally known adhesive seal, and the transfer mark may be once peeled and adhered again like an adhesive seal, or peeled off and removed when not needed.

In the case of the transfer mark composed of a mark and an overwriting blank space, letters can be written in the overwriting blank space after transfer by using a writing tool.

These and other objects and features of the invention will be better understood and appreciated by reading the novel facts disclosed in the detailed description given in conjunction with the accompanying drawings and the claims.

BRIEF DESCRIPTION OF THE DRAWINGS

FIG. 4(*b*) is a plan view of essential parts of the transfer head.

FIG. 4(*c*) is a side sectional view of essential parts of the transfer head.

FIG. 5(*b*) is a sectional view along line A—A in FIG. 5(*a*) of the mark transfer tape.

FIG. 5(*c*) is a sectional view of peeling state of base tape and transfer mark of the mark transfer tape.

FIG. 9(*b*) is also a perspective view of state of use of the mark transfer tool, showing a lateral pulling state by left hand.

FIG. 9(*c*) is a perspective view of state of use of the mark transfer tool, showing a vertical pulling state by right hand.

FIG. 10(*b*) is a magnified plan view of the transfer mark of the mark transfer tape.

FIG. 10(*c*) is a sectional view along line A—A in FIG. 10(*a*).

FIG. 11(*b*) is a plan view of modified example of the transfer mark.

FIG. 11(*c*) is a plan view of other modified example of the transfer mark.

FIG. 12(*b*) is a sectional view along line A—A in FIG. 12(*a*) of the transfer mark.

FIG. 12(*c*) is a perspective view showing an overwriting state by a writing tool after mark transfer of the mark transfer tool.

FIG. 13(*b*) is a sectional view along line A—A in FIG. 13(*a*) of the mark transfer tape.

FIG. 13(*c*) is a sectional view of peeling state of base tape and transfer mark of the mark transfer tape.

FIG. 14(*b*) is a sectional view along line A—A in FIG. 14(*a*) of the mark transfer tape.

FIG. 14(*c*) is a sectional view of peeling state of base tape and transfer mark of the mark transfer tape.

FIG. 15(*b*) is a sectional view along line A—A in FIG. 15(*a*) of the mark transfer tape.

FIG. 15(*c*) is a sectional view of peeling state of base tape and transfer mark of the mark transfer tape.

FIG. 16(*b*) is a sectional view along line A—A in FIG. 16(*a*) of the mark transfer tape.

FIG. 16(*c*) is a sectional view of peeling state of base tape and transfer mark of the mark transfer tape.

FIG. 17(*b*) is a sectional view along line A—A in FIG. 17(*a*) of the mark transfer tape.

FIG. 17(*c*) is a sectional view of peeling state of base tape and transfer mark of the mark transfer tape.

FIG. 18(*b*) is a sectional view along line A—A in FIG. 18(*a*) of the mark transfer tape.

FIG. 18(*c*) is a sectional view of peeling state of base tape and transfer mark of the mark transfer tape.

FIG. 19(*b*) is a sectional view along line A—A in FIG. 19(*a*) of the mark transfer tape.

FIG. 19(*c*) is a sectional view of peeling state of base tape and transfer mark of the mark transfer tape.

FIG. 20(*b*) is a sectional view along line A—A in FIG. 20(*a*) of the mark transfer tape.

FIG. 20(*c*) is a sectional view of peeling state of base tape and transfer mark of the mark transfer tape.

FIG. 21(*b*) is a sectional view along line A—A in FIG. 21(*a*) of the mark transfer tape.

FIG. 21(*c*) is a sectional view of peeling state of base tape and transfer mark of the mark transfer tape.

FIG. 22(*b*) is a sectional view along line A—A in FIG. 22(*a*) of the mark transfer tape.

FIG. 22(*c*) is a perspective view of essential parts of transfer head of the mark transfer tool.

FIG. 26(*b*) is a plan view of essential parts of the transfer head.

FIG. 26(*c*) is a side sectional view of essential parts of the transfer head.

FIG. 27(*b*) is a plan view of essential parts of the transfer head.

FIG. 27(*c*) is a side sectional view of essential parts of the transfer head.

FIG. 28(*b*) is a plan view of essential parts of the transfer head.

FIG. 28(*c*) is a side sectional view of essential parts of the transfer head.

FIG. 29(*b*) is a perspective view of the transfer head, showing vertical pulling type.

DETAILED DESCRIPTION OF THE PREFERRED EMBODIMENTS

Figure 1:
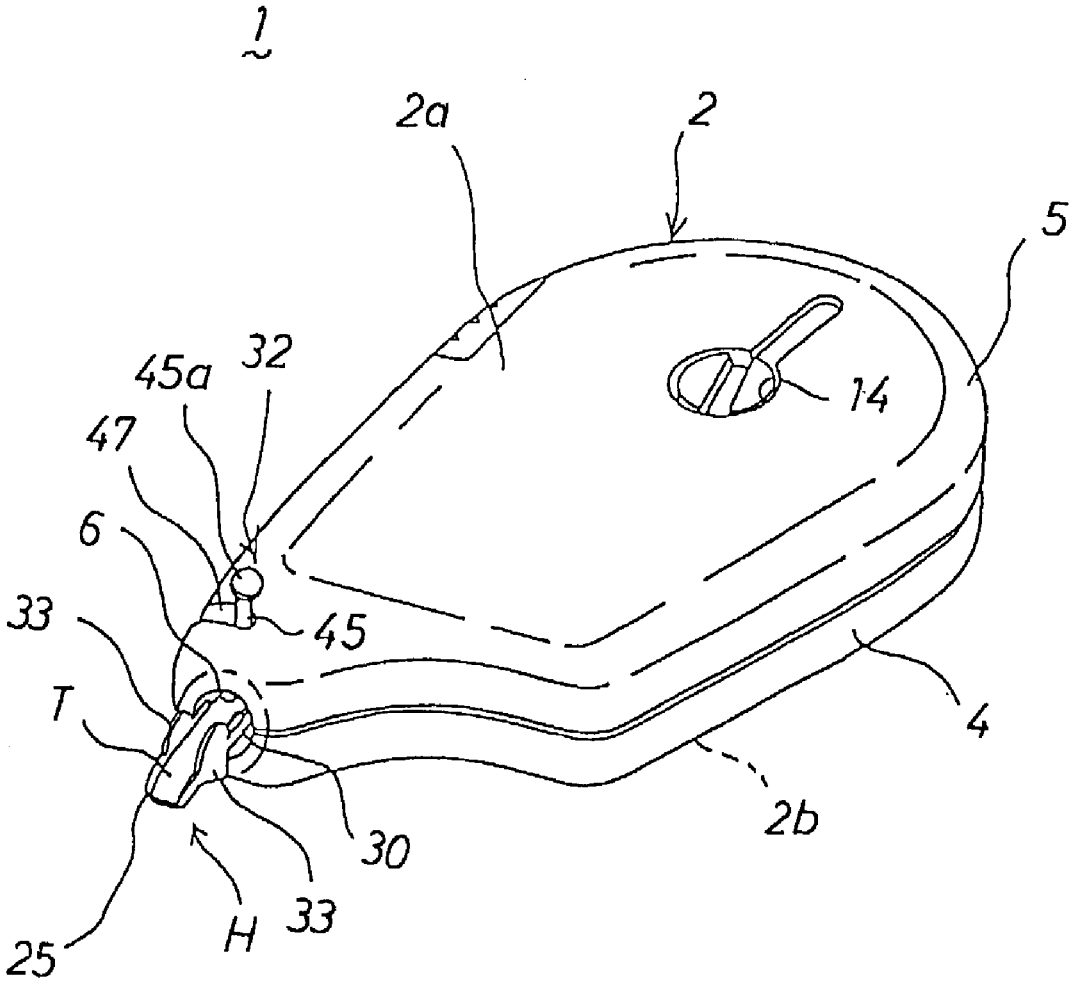
FIG. 1 is a perspective view of mark transfer tool in embodiment 1 of the invention.

Referring now to the drawings, preferred embodiments of the invention are specifically described below.

FIG. 1 through FIG. 29 show the mark transfer tool of the invention, and same reference numerals refer to same constituent members or elements throughout the drawings.

Embodiment 1

The mark transfer tool according to this embodiment is shown in FIG. 1 to FIG. 9. This mark transfer tool 1 is, specifically, to transfer marks combining characters, codes, patterns or their combination arranged and formed on a mark transfer tape T (in the shown example, only a mark composed of alphabetic letters SEED) M, M, . . . , to a sheet of paper or the like, and it is a refill type having a cartridge structure allowing to exchange the mark transfer tape T as a consumable part.

Figure 2:
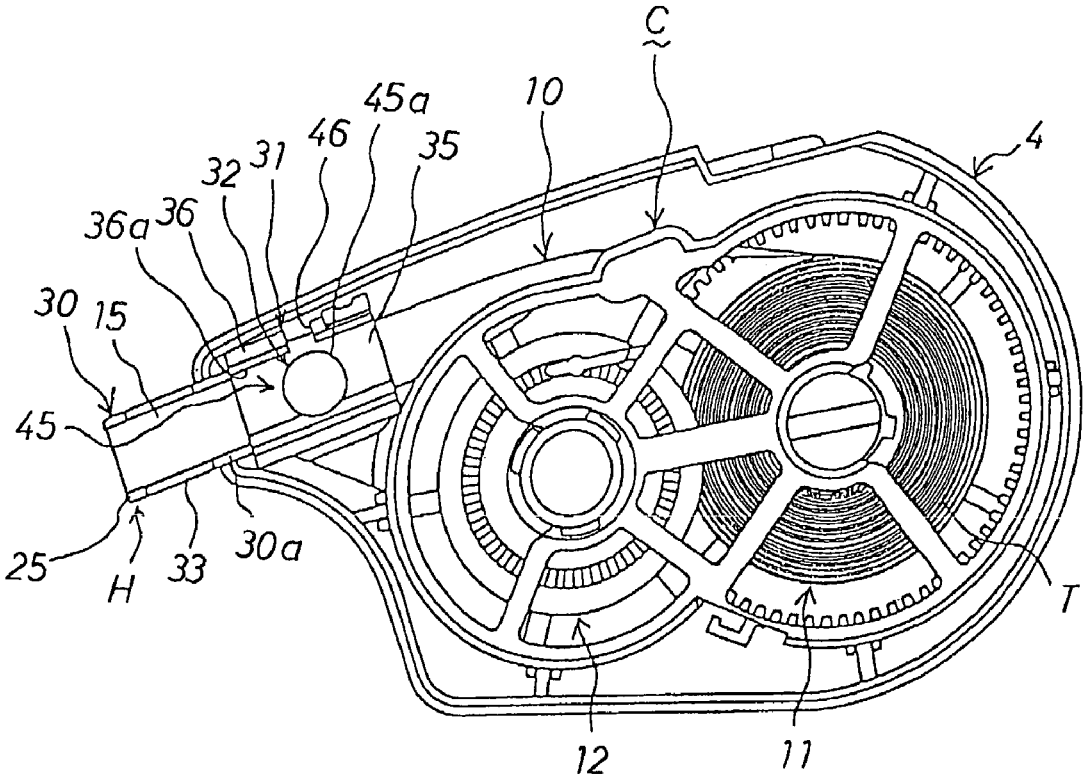
FIG. 2 is a front view of case main body inside of the mark transfer tool.
Figure 3:
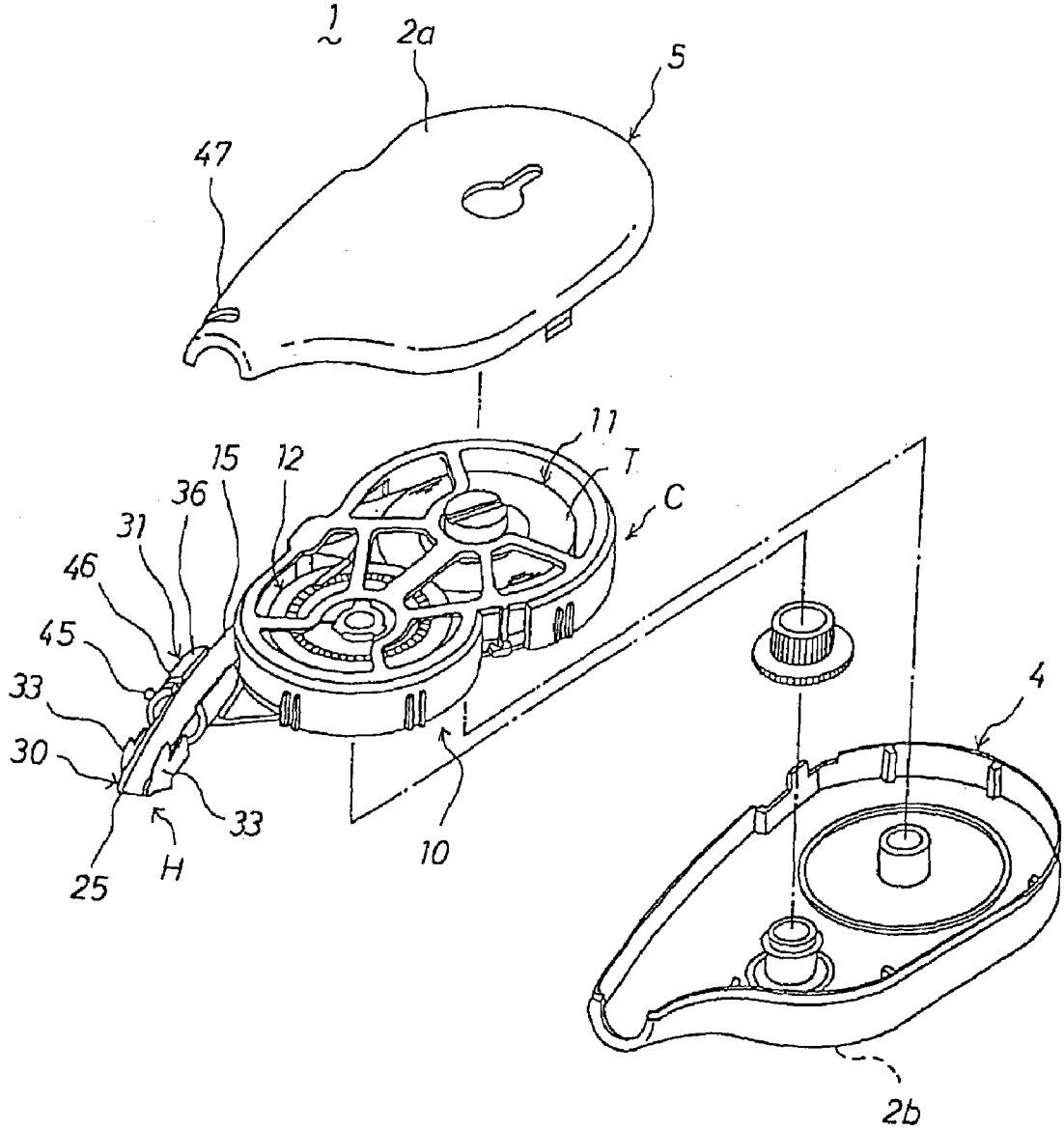
FIG. 3 is a perspective exploded view of the mark transfer tool.

That is, the mark transfer tool 1 comprises a case 2 having an appearance as shown in FIG. 1, and a tape cartridge C having a transfer head H as shown in FIG. 2 and FIG. 3. The individual constituent parts are explained sequentially below.

I. Case 2

The case 2 is held and manipulated by one hand, and is a flat box having a front contour shape and dimension and width enough to incorporate the tape cartridge C as shown in the drawing, and its confronting pair of flat face and back sides 2*a*, 2*b* are standard gripping sides when holding and manipulating by one hand. The case 2 is a plastic structure integrally formed by injection molding or the like, and a case main body 4 and a cap body 5 are separate, and the tape cartridge C is detachably inserted in the case main body 4. At the leading end of the case 2, a head inserting portion 6 for inserting the transfer head H in and out is formed.

II. Tape Cartridge C

The tape cartridge C is an exchangeable consumable part. The tape cartridge C consists of a payoff reel 11 on which a mark transfer tape T is wound, and a take-up reel 12 for collecting the mark transfer tape T after use, which are rotatably installed in a cartridge case 10, and further a transfer head H for pressing and transferring the mark transfer tape T to the transfer area is installed rotatably about the head axial center.

Although not specifically shown in the drawing, the tape cartridge C further includes a tape interlocking unit for mutually interlocking the payoff reel 11 and take-up reel 12, a clutch mechanism for synchronizing the payoff speed and take-up speed of the mark transfer tape T in the payoff reel 11 and take-up reel 12, and other principal and basic components, which are assembled as a unit.

The cartridge case 10 is made of synthetic resin in a form of a cartridge case for accommodating the both reels 11, 12, and its shape and dimensions are set to be lightweight and compact in a range of having holding functions of both reels 11, 12, and more specifically it is a skeletal structure mainly composed of thin skeletal members.

III. Mark Transfer Tape T

The mark transfer tape T is to supply transfer marks M continuously, and multiple pressure-sensitive adhesive transfer marks M, M, . . . are disposed and held on the surface of a base tape 15 continuously and peelably at specified intervals.

Figure 5A:
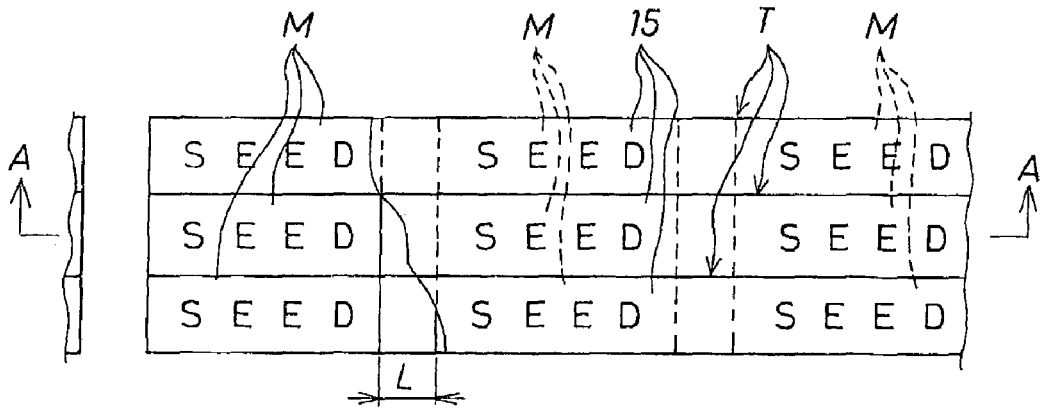
FIG. 5(*a*) is a partially cut-away plan view of the mark transfer tape in manufacturing process, showing the mark transfer tape of the mark transfer tool.
Figure 5B:
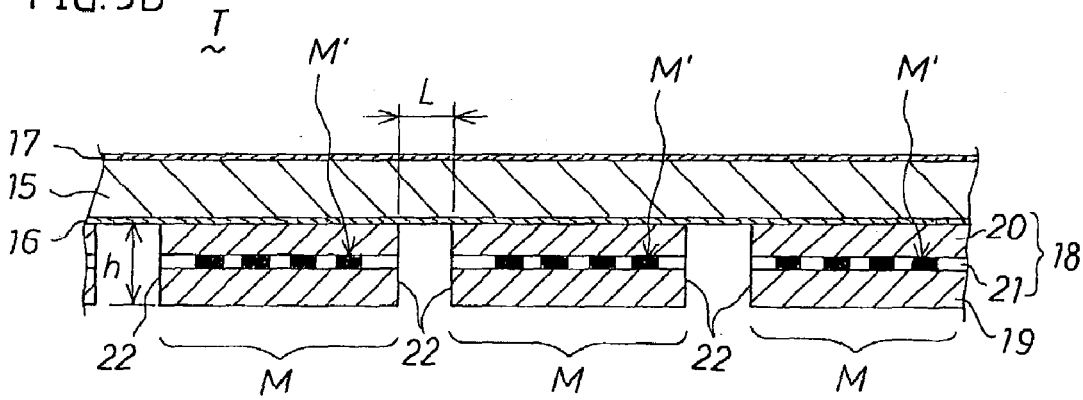
Figure 5C:
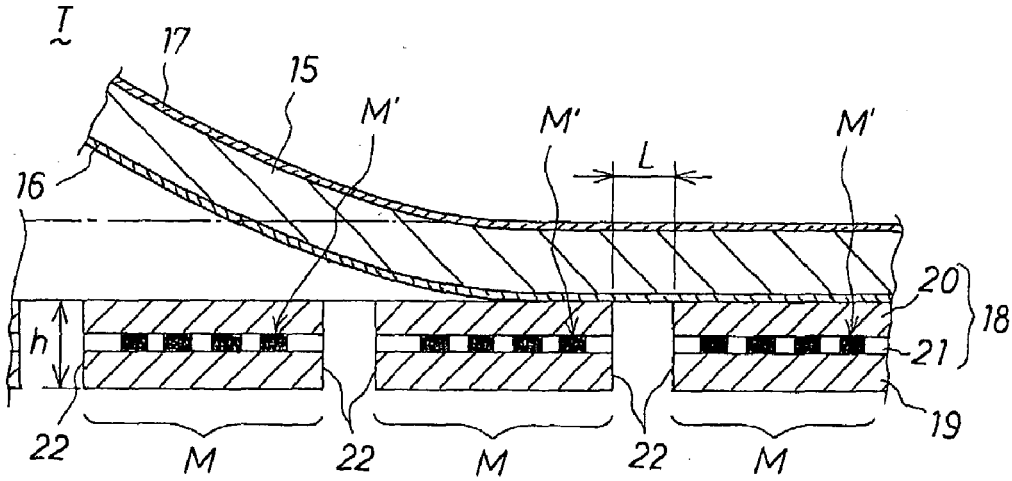

In the shown embodiment, the mark transfer tape T has a sectional structure as shown in FIG. 5, and on the surface of the base tape 15 (the lower side in FIG. 5(*b*) and FIG. 5(*c*)), multiple transfer marks M, M, . . . are peelably adhered and held. Since the drawings are intended to help understanding, they are schematic and magnified in the thickness direction, but actually the mark transfer tape T is a thin film, and the boundary of layers is not so clear as illustrated.

The base tape 15 functions as a support base until the transfer mark M is transferred on the transfer area, and it is a film tape made of polyethylene terephthalate (PET), polyethylene, propylene, other plastic material or paper material, and a non-stretchable flexible film is preferably used. The thickness of the base tape 15 is set at about 4 to 100 μm.

The surface of the base tape 15 is treated by forming a slight adhesive layer 16, and the back side of the base tape 15 is treated by forming a peelable layer 17.

The slight adhesive layer 16 bears the function as the support base, and more specifically when holding the mark transfer tape T, the transfer mark M is adhered and fixed stably on the base tape 15, or when transferring the mark, it helps to peel the transfer mark M easily from the base tape 15.

As the constituent material of the slight adhesive layer 16, a slight adhesive composition such as acrylic adhesive is preferably used, and, for example, a slight adhesive plastic material is applied on the base tape 15, dried, and treated by sand blasting, and a slight adhesive layer 16 is formed.

The peelable layer 17 is intended to separate or peel off mutually adjacent layers or materials, and more specifically it prevents sticking with the transfer mark M when storing the mark transfer tape T by winding in a roll, or it helps the transfer mark M to be peeled easily from the base tape 15 so as to be transferred.

As the constituent material of the peelable layer 17, silicone parting agent, fluorine parting agent, and other parting agent is preferably used, and this parting agent is applied and dried on the base tape 15, and a peelable layer 17 is formed.

The transfer mark M is specifically formed as an adhesive seal, and as described below the adhesive force of the back-side pressure-sensitive adhesive layer adhered to the transfer area on the sheet of paper is set larger than the adhesive force on the base tape 15. This transfer mark M has a laminated structure integrally laminating and forming a mark main body 18 and a pressure-sensitive adhesive layer 19, and has a square or rectangular contour shape as shown in the drawing.

The mark main body 18 is formed by integrally laminating a surface layer 20 forming the transfer mark surface and a mark layer 21 forming a specified mark.

The surface layer 20, in the shown embodiment, provides the transfer mark M with a characteristic as seal body, and also has a protective function of forming a surface layer of transfer mark M after transfer.

The surface layer 20 is preferably made of one or more transparent and see-through synthetic resin or natural resin materials having toughness as seal body, or ultrathin films made of these resin materials or paper materials, and more preferably a resin mixture of rubber like resin and glass like resin is used. By combined use of rubber like resin and glass like resin, the surface layer 20 comes to have excellent properties in the aspects of flexibility, writing performance, and cutting performance, including the characteristics as the seal body.

Examples of the rubber like resin include styrene-butadiene-styrene block copolymer (SBS), styrene-ethylene-butylene-styrene block copolymer (SEBS), styrene-butadiene rubber, styrene-isoprene-styrene block copolymer (SIS), styrene-ethylene/propylene block copolymer (SEP), urethane rubber, fluororubber, acrylonitrile-butadiene rubber, ethylene-vinyl acetate copolymer, ethylene-ethyl acrylate copolymer, chlorosulfonated polyethylene, cyclic rubber, other ordinary synthetic rubber, and rubber like resins, and one or more types used together. A plasticizer may be added as required.

The glass like resin should have a melting point or softening point of 100° C. or higher, and also have a high hardness, and usable examples include saturated or unsaturated alicyclic hydrocarbon resin, styrene-acrylic copolymer resin, ketone resin, vinyl chloride-vinyl acetate copolymer resin, polyethylene, polypropylene, or other polyolefin resins.

To prepare the surface layer 20, a resin composition having one or more resin materials mentioned above dissolved as required in a solvent is applied and formed on the base tape 15 by a known coating method such as blade coater, roll coater, air knife coater, bar coater, or gravure coater.

As mentioned above, when the rubber resin and glass resin are combined, their specific blending rate varies with the elongation and other properties of the rubber resin and glass resin, but generally in 100 parts by weight of rubber resin, glass resin is mixed by about 2 to 30 parts by weight, preferably 5 to 15 parts by weight.

Further, a light diffusion agent or coloring matter (pigment or dyestuff) may be blended in the surface layer 20, and the surface layer 20 may be made translucent or be colored, but on the whole the surface layer 20 is preferred to be colorless and transparent from the viewpoint of visual recognition of the mark layer 21.

The thickness of the surface layer 20 is set at 5 to 40 μm, preferably 7 to 20 μm.

The mark layer 21 is a layer composed mainly of mark M' (only mark of alphabetical letter SEED in the shown example) of mark transfer tape T, and in the illustrated embodiment, it is printed on the surface layer 20 by a known printing technology.

Although not shown, the constituent material of the mark layer 20 includes is same as the material of surface layer 20 mentioned above, and is further blended with light diffusion agent or coloring matter (pigment or dyestuff), or metal foils or multiple small pieces for composing lame or other decorative pattern, and the mark layer 20 may be formed as a layer having colored translucent or colored opaque decorative pattern. Further, although not shown, an ultrathin mirror film may be used as the mark layer 20, and the transfer mark M may be formed as a mirror seal, or an ultrathin decorative cloth may be used, and the transfer mark M may be formed as graphic or pattern seal.

The printing method of the mark layer 21 includes various known printing techniques, specifically, traditional printing techniques such as typographic (relief) printing, offset printing, gravure (intaglio) printing, silk screen printing or tampon printing, and reverse roll coating, direct coating and other coater methods, spray coating, electrostatic coating, flow coating, roller coating, immersion coating, and further novel printing techniques such as laser printer, heat transfer, and ink jet printer systems, which may be properly selected depending on the properties of the forming object area (in the shown case, the surface layer 20).

The mark layer forming ink is composed of resin and coloring matter, which are dissolved and dispersed as required in a solvent.

As the resin, the rubber resin mentioned above may be used. That is, it is composed by using one or more types selected from the group consisting of styrene-butadiene-styrene block copolymer (SBS), styrene-ethylene-butylene-styrene block copolymer (SEBS), styrene-butadiene rubber, styrene-isoprene-styrene block copolymer (SIS), styrene-ethylene/propylene block copolymer (SEP), urethane rubber, fluororubber, acrylonitrile-butadiene rubber, ethylene-vinyl acetate copolymer, ethylene-ethyl acrylate copolymer, chlorosulfonated polyethylene, cyclic rubber, other ordinary synthetic rubber, and rubber resins. Still more, plasticizer may be added as required.

As the coloring matter, any known coloring matter used in general printing ink may be used properly.

Such printing layer forming ink is printed and dried on the surface layer 20 or pressure-sensitive adhesive layer 19 mentioned below, and the mark layer 21 is formed. The thickness of the mark layer 21 is usually 0.1 to 5 μm, preferably 0.3 to 1.0 μm.

The pressure-sensitive adhesive layer 19 is for pressing and adhering the transfer mark M on the transfer area, and a surface layer of mark transfer tape T before transfer is formed, and the constituent material of this pressure-sensitive adhesive layer 19 is preferably a so-called dry type adhesive suited to the surface layer before parting, having pressure-sensitive adhesive property.

Examples of this adhesive preferably include known adhesive agents such as rubber adhesive and acrylic adhesive, that is, the rubber adhesive of natural rubber, isoprene rubber, or styrene butadiene rubber blended with adhesive compound (rosin resin, terpene resin, terpene phenol resin, etc.), or the acrylic adhesive mainly composed of (meth) acrylic ester.

By applying such adhesive on the surface layer 20 having the mark layer 21 by the conventional technique, the pressure-sensitive adhesive layer 19 is integrally laminated and formed on the mark main body 18. The thickness of the pressure-sensitive layer 19 is usually 5.0 to 25.0 μm, preferably 10 to 20 μm.

By this pressure-sensitive adhesive layer 19, the adhesive force of the back-side pressure-sensitive adhesive layer of the transfer mark M applied on the transfer area is set higher than the adhesive holding force on the base tape 15. In this embodiment, the pressure-sensitive adhesive layer 19 is formed on the entire back side surface of the transfer mark M, and therefore the transfer mark M is formed as a so-called contact seal having the whole surface adhered on the transfer area.

The transfer marks M formed in such laminated structure are adhered and held on the peelable surface of the base tape 15 (at the lower surface of forming the peelable layer 17 in FIG. 5(*b*) and FIG. 5(*c*)), peelably at specified intervals through the surface layer 20 as shown in FIG. 5(*a*) to FIG. 5(*c*).

In this case, disposing intervals of the transfer marks M, M, . . . in the mark transfer tape T are set so as to be transferred easily and securely when transferring each transfer mark M. More specifically, both edge lines (sides) in the longitudinal direction of rectangular transfer marks M are extended and formed linearly in the width direction vertical to the longitudinal direction of the mark transfer tape T, and the spacing of mutually adjacent transfer marks M, M, that is, the disposing interval L is set larger than the pressurizing width I of the leading end pressing portion 25 of the transfer head H mentioned below (L>I).

Moreover, since the transfer mark M is formed as an adhesive seal, this transfer mark M itself as a certain thickness although it is very thin, and this thickness is utilized positively in this embodiment, and division bodily feeling means is composed so that the user can feel the division of transfer marks M, M bodily.

That is, due to thickness of the transfer mark M itself, a step 22 having a very small step difference h is formed between the surfaces of each transfer tape M and base tape 15 in the mark transfer tape T, and this step 22 functions as division bodily feeling means in collaboration with the leading end pressing portion 25 of the transfer head H.

More specifically, in the mark transfer operation explained below, when the step 22 is engaged with the leading end pressing portion 25 of the transfer head H, the step difference h at this time of engagement is felt bodily by the finger of the user (bodily sensation indication), so that the transfer division position of one transfer mark M can be body felt.

As a specific manufacturing method of mark transfer tape T having such configuration, the so-called die cutting method of printing method may be employed preferably.

First, in the manufacture of mark transfer tape T by the die cutting method, the mark main body 18 and pressure-sensitive adhesive layer 19 composing the transfer marks M are sequentially laminated and formed on the entire surface of the face of the base tape 15, and multiple cutting lines of specified transfer contour shape are cut at specified intervals in the laminated layer only of the mark main body 18 and pressure-sensitive adhesive layer 19 by die cutting means, and finally the laminated layers around the transfer mark contour shapes are removed.

On the other hand, in the manufacture of mark transfer tape T by the printing method, the mark main body 18 and pressure-sensitive adhesive layer 19 composing the transfer marks M are sequentially laminated and printed on the surface of the base tape 15, in specified transfer mark contour shapes by various printing techniques mentioned above, and multiple transfer marks M, M, . . . are laminated and formed at specified intervals.

Figure 6:
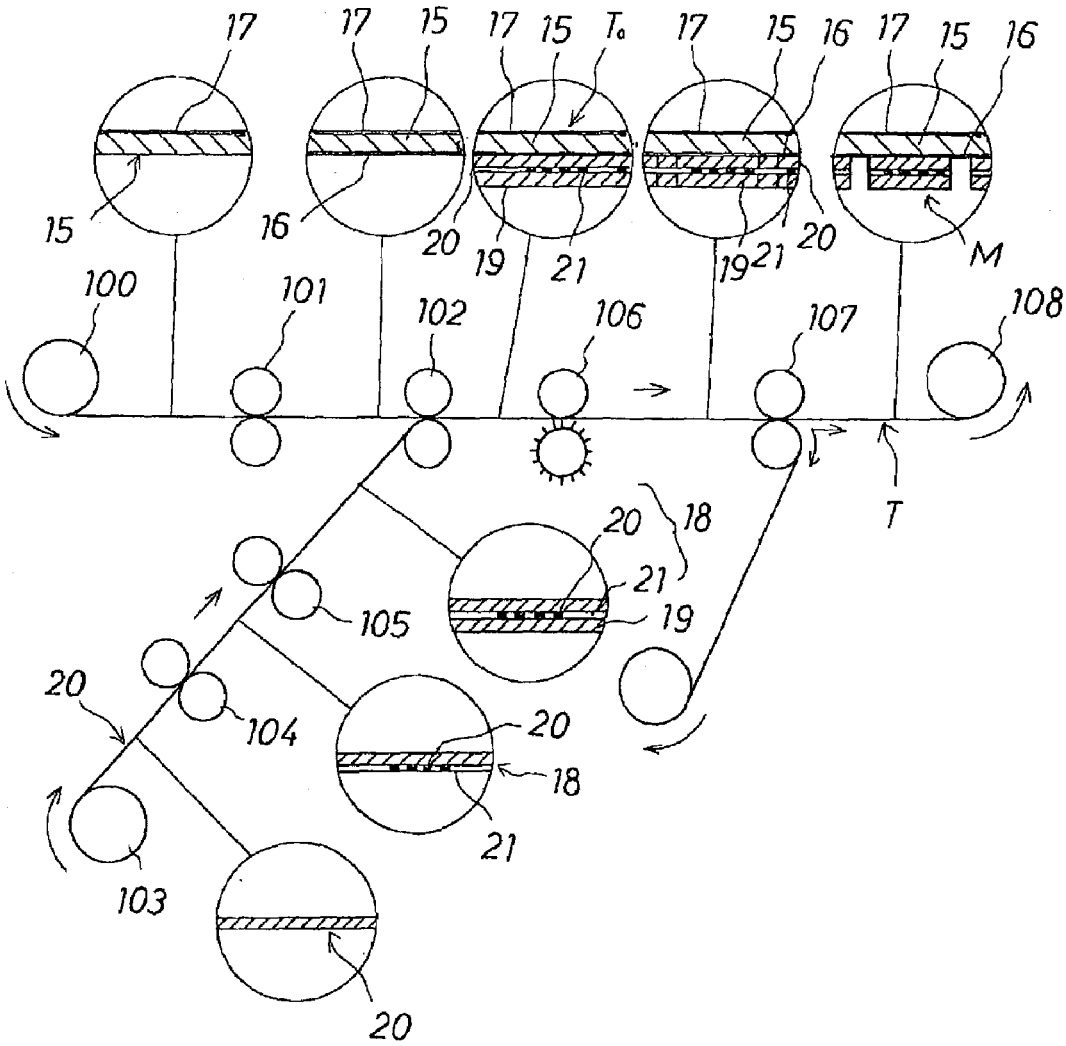
FIG. 6 is a schematic process diagram of manufacturing the mark transfer tape of mark transfer tool by die cutting method.

These manufacturing methods are actually composed of a consecutively series of steps, and the manufacturing process of mark transfer tape T by the die cutting method is composed as follows (see FIG. 6).

i) From a base tape supply unit 100, for example, paper-made base tapes 15 preliminarily forming peelable layers 17 on the back side are supplied continuously, and a slight adhesive layer 16 is formed on the entire surface by a slight adhesive processing unit 101, and the tapes are sent into a laminating unit 102.

ii) On the other hand, from a surface layer supply unit 103, for example, PET tapes used as surface layer 20 are supplied consecutively, and mark layers 21 are printed on the entire surface by a printing unit 104, and mark main bodies 18 are laminated and formed, and a pressure-sensitive adhesive layer 19 is formed thereon successively by an adhesive application unit 105, and the tapes are also sent into the laminating unit 102.

iii) In the laminating unit 102, the back side of the laminated tape, that is, the surface layer 20, composed of mark main body 18 (surface layer 20+mark layer 21) and pressure-sensitive adhesive layer 19 is laminated on the surface forming the slight adhesive layer 16 of the base tape 15, and a prototype tape To of mark transfer tape T is formed, and sent into a die cutting unit 106.

iv) In the die cutting unit 106, cutting lines of specified transfer mark contour shapes (rectangular shapes in the shown embodiment) are continuously formed by die cutting at specified intervals only on the laminated layer of the mark main body 18 and pressure-sensitive adhesive layer 19 of the prototype tape To.

v) From the prototype tape To processed by the die cutting unit 106, the laminated layers around the transfer mark contour shapes are peeled and removed by a waste removal unit 107, and a mark transfer tape T is completed, and taken up and collected in a completed tape container 108.

Thus completed mark transfer tape T is initially manufactured as a band having tape width dimension such as plural mark transfer tapes T, T, . . . as shown in FIG. 5(*a*), and then cut and formed into one tape T width by a cutting device such as slitter.

IV. Transfer Head H

The transfer head H presses the mark transfer tape T to a correction area on a sheet of paper, and it is disposed at the leading end of the cartridge case 10, and has a function of guiding the mark transfer tape T and a function of pressing.

A specific structure of the transfer head H comprises a head main body 30, a head holding portion 31, and a rotary operation portion 32, and the head main body 30 is held rotatably about its axial center, that is, a so-called rotary head structure is formed.

The head main body 30 is to press and transfer the mark transfer tape T, and is shaped to be suited to transfer accurately to a desired transfer position, that is, the transfer head H is formed as a pointed head in a pointed form The head main body 30 in the shown embodiment is a thin plate having a rectangular shape slightly wider than the mark transfer tape T, and has a taper section, being pointed in a side view so as to be gradually thin toward the leading end.

The head main body 30 has flat both side surfaces 30*a*, 30*b*, which form tape running surfaces, and a leading edge 25 is a leading end pressing portion for pressing the mark transfer tape T as mentioned above. This leading end pressing portion 25 is a straight edge orthogonal to the tape running direction in the tape running surfaces 30*a*, 30*b*. At both side edges of the head main body 30, guide flanges 33, 33 are formed for guiding running of mark transfer tape T.

If the thickness of the plate for composing the head main body 30 is relatively small, tapering as shown in the drawing is not always necessary, but the plate thickness may be uniform throughout the longitudinal direction, and anyway the structure is not particularly specified as far as the leading end of the pressing portion 25 of the head main body 30 has a thickness (a point) enough to position and indicate the transfer position accurately.

The material characteristic of the head main body 30 is set in consideration of the pressing action of the mark transfer tape T required in its leading end pressing portion 25, and the transfer mark M is prepared as a seal, and hence either flexible head or rigid head may be employed depending on the purpose.

That is, in the case it is desired that the entire transfer mark M should be fixed tightly and uniformly to the transfer area, the head main body 30 is preferred to have a flexible characteristic in the pressing direction of mark transfer tape T, and a flexible head is desired as the transfer head H.

On the other hand, in the case it is desired that only part of the transfer mark M should be securely fixed tightly to the transfer area or fixed provisionally, it is preferred that the head main body 30 may not deform flexibly in the pressing direction of mark transfer tape T, and a rigid head is desired as the transfer head H.

At the base end side portion of the head main body 30, further, a borne portion 35 is integrally formed as a main body support.

The head holding portion 31 supports the head main body 30 rotatably about its axial center, and specifically comprises the borne portion 35 as the main body support, and a bearing 36 provided in the cartridge case 10.

Figure 8A:
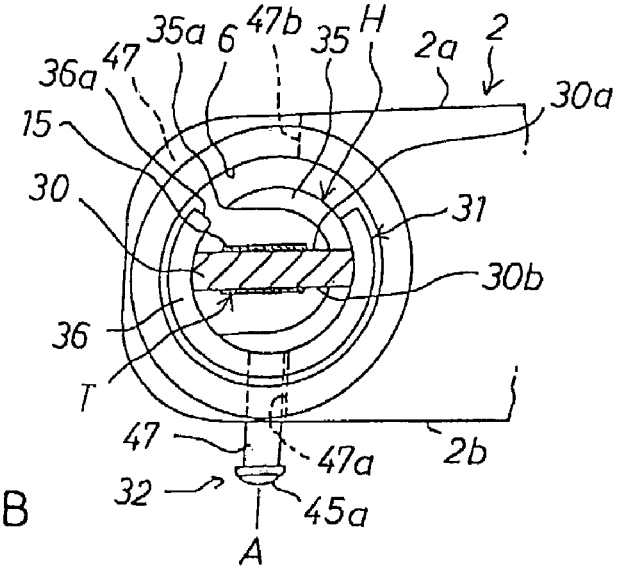
FIG. 8, consists of FIGS. 8A to 8C and are magnified front views showing a part of sections of rotary structure of the transfer head of the mark transfer tool.
Figure 8B:
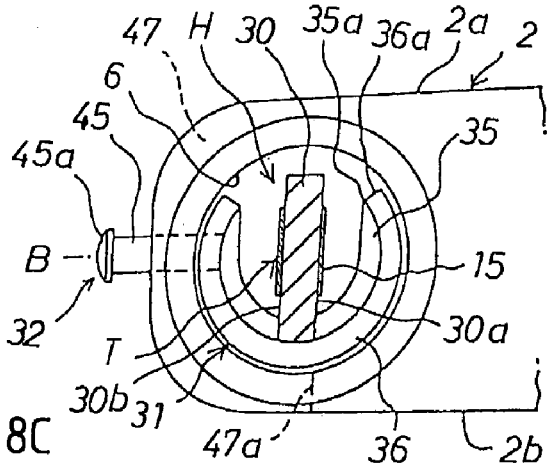
Figure 8C:
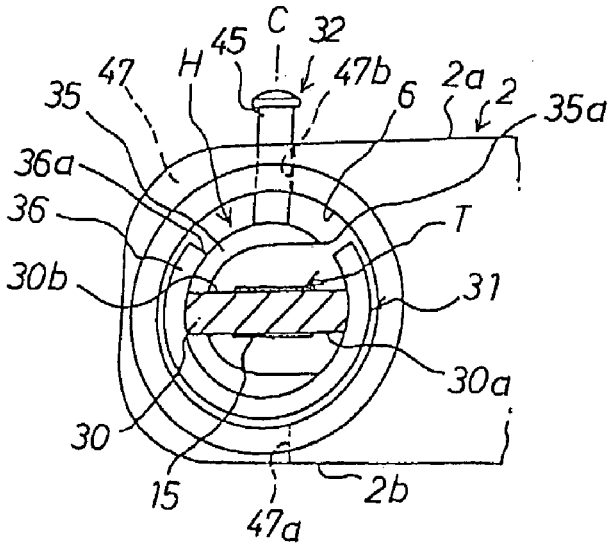

The borne portion 35 is, as shown in FIG. 8(*a*) to FIG. 8(*c*), a cylindrical portion provided concentrically and integrally with the head main body 30, and more specifically it is formed in an arc section having a setting opening 35*a* of mark transfer tape T to the head main body 30 in a part thereof.

The bearing 36 is disposed integrally at the leading end of the cartridge case 10. As shown in FIG. 8, the bearing 36 is a tubular piece having an inner circumference corresponding to the outer circumference of the borne portion 35, and same as the borne portion 35, it is formed in an arc section having a setting opening 36*a* of mark transfer tape T to the head main body 30 in a part thereof. The born portion 35 is slidably supported on the bearing 36, and the head main body 30 is freely rotatable about the axial center in a specified rotating angle range described below.

The rotary operation portion 32 is to determine the rotating direction position of the head main body 30, and also serves as head position indicator to show the tape pressing and transferring position of the head main body 30.

The rotary operation portion 32 is a circular bar, and has an operation lever 45 including an operation knob 45*a* disposed at its leading end as a principal unit. The operation lever 45 is extended linearly outward in the radial direction from the axial center of the born portion 35, and projects to the outside of the case 2, through a slit inserting portion 46 and an operation guide portion 47 disposed at corresponding positions in the bearing 36 and case 2. In this case, the inserting portion 46 of the bearing 36 functions as a locking portion of the head main body 30 to prevent it from slipping out in the axial direction.

The location of the operation lever 45 in the rotating direction with respect to the head main body 30 is set in relation to the tape pressing and transferring position of the head main body 30, and the inserting portion 46 and operation guide portion 47 are extended in the peripheral direction so as to allow moving of the operation lever 45 in the rotating direction of the head main body 30. In particular, the operation guide portion 47 of the case 2 defines the operating range in the rotating direction of the operation lever 45, and is configured to control the tape pressing and transferring position of the head main body 30.

The relation of the operation lever 45 and the tape pressing and transferring position of the head main body 30 is explained with respect to the operation guide portion 47. In the shown embodiment, the configuration of the operation guide portion 47 as the operation range defining portion in the rotating direction is set follows, referring to FIG. 8(*a*) to FIG. 8(*c*).

(a) When the operation lever 45 is in contact with one end 47*a* of the operation guide portion 47, that is, in the vertical downward position (first defined position A shown in FIG. 8(*a*)), the head main body 30 of the transfer head H is located at an angular position for guiding its leading end pressing portion 25 so that the mark transfer tape T may be nearly opposite to the gripping surfaces 2*a*, 2*b* of the case 2, that is, the face and back sides of the mark transfer tape T may be directed nearly in the same direction as (parallel to) the gripping surfaces 2*a*, 2*b*.

Figure 9A:
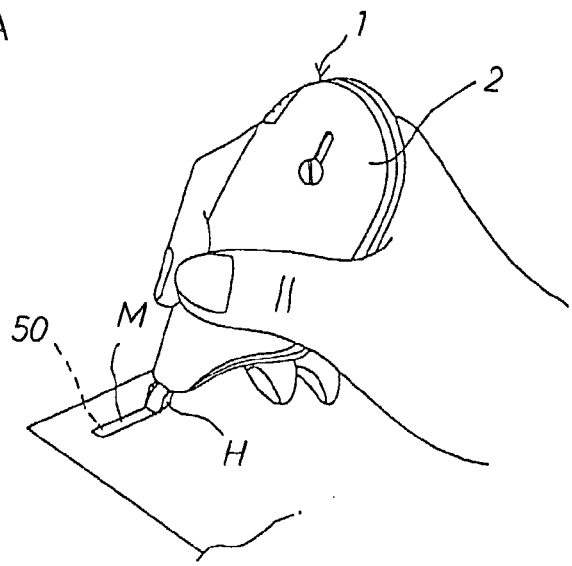
FIG. 9(*a*) is a perspective view of state of use of the mark transfer tool, showing a lateral pulling state by right hand.
Figure 9B:
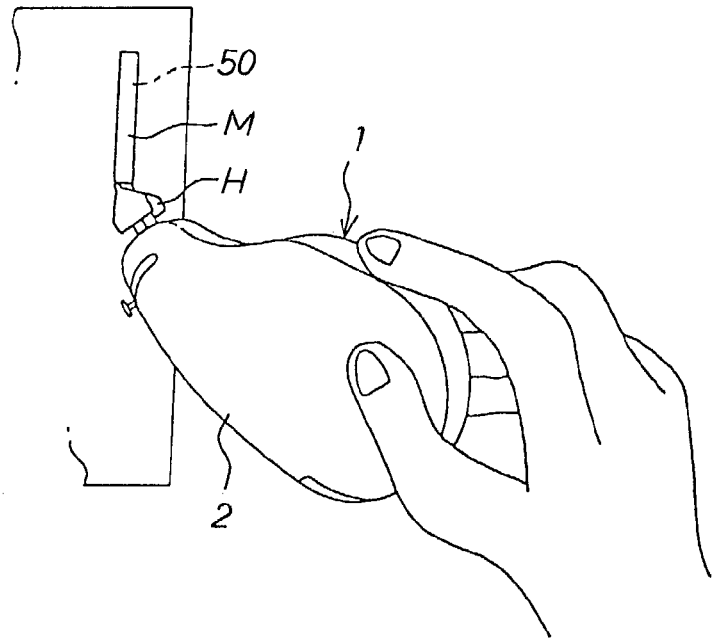
Figure 9C:
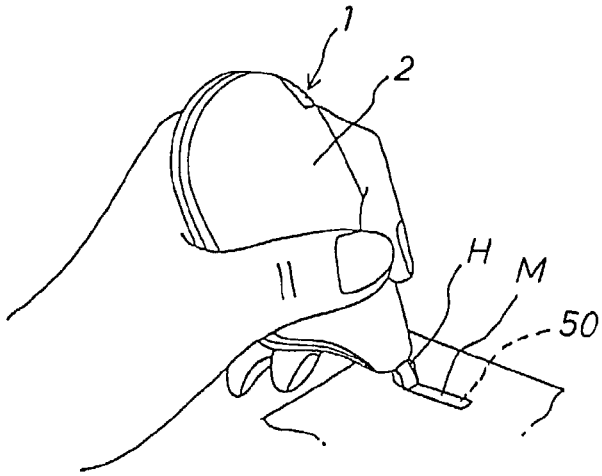

In this case, the new mark transfer tape T rolled out from the payoff reel 11 is at the lower side of the head main body 30, and is in a state suited to use by lateral pull by a right-handed user (see FIG. 9(*a*)).

(b) When the operation lever 45 is at an intermediate position between both ends 47*a*, 47*b* of the operation guide portion 47 of the operation lever, that is, in the horizontal downward position (second defined position B shown in FIG. 8(*b*)), the head main body 30 of the transfer head H is located at an angular position for guiding its leading end pressing portion 25 so that the mark transfer tape T may remain in wound state on the payoff reel 11 and take-up reel 12, that is, the face and back sides of the mark transfer tape T may be directed in a nearly vertical direction (orthogonal) to the gripping surfaces 2*a*, 2*b*.

In this case, the new mark transfer tape T rolled out from the payoff reel 11 is at the left side of the head main body 30, and is in a state suited to use by vertical pull (see FIG. 9(*b*)).

(c) When the operation lever 45 is in contact with other end 47*b* of the operation guide portion 47, that is, in the vertical upward position (third defined position C shown in FIG. 8(*c*)), the head main body 30 of the transfer head H is located at an angular position for guiding its leading end pressing portion 25 so that the mark transfer tape T may be nearly opposite to the gripping surfaces 2*a*, 2*b* of the case 2, in the upside down state of the case (a) above.

In this case, the new mark transfer tape T rolled out from the payoff reel 11 is at the upper side of the head main body 30, and is in a state suited to use by lateral pull by a left-handed user (see FIG. 9(*c*)).

As clear from the description above, the direction of the operation lever 45 directly and visually shows the opposite direction of the new mark transfer tape T (function as head position indicator), and the user can confirm the tape pressing and transferring position of the head main body 30 by referring to the direction of the operation lever 45.

The rotating direction operating range of the operation guide portion 47 (nearly 180° at maximum in shown example) can be set in various desired values from a small angle range to a large angle range in consideration of relation between the operation lever 45 and the tape pressing and transferring position of the head main body 30.

Using the mark transfer tool 1 having such configuration, to transfer the transfer mark M on the mark transfer tape T onto a desired transfer area 50 on a sheet of paper or the like, whether the user is right-handed or left-handed as mentioned above, the operation lever 45 can be rotated according to the purpose, and an optimum tape pressing and transferring position of the head main body 30 of the transfer head H (typically, first defined position A shown in FIG. 8(*a*), second defined position B shown in FIG. 8(*b*), or third defined position C shown in FIG. 8(*c*)) can be selected and set, and corresponding to this position, the case 2 can be gripped by fingers on the gripping surfaces (standard gripping surfaces are face and back sides 2*a*, 2*b* of the case 2, but proper positions or sides of the case 2 may be gripped depending on the purpose), so that various methods of use, for example, as shown in FIG. 9(*a*) to FIG. 9(*c*) may be possible.

That is, in any method of use, the gripping surfaces of the case 2 are held like holding a writing tool, and the leading end pressing portion 25 of the transfer head H is pressed tightly to the transfer start end of the transfer area 50 on a sheet of paper or the like, and the case 2 is moved along the sheet of paper by a specified distance and stopped.

More specifically, in a completion state of previous mark transfer operation, the transfer head H is tightly pressed to the transfer start end on the transfer area 50, and the case 2 is directly moved along the sheet of paper, and is stopped when transfer of one (or plural) transfer marks M is completed, and the transfer head H is lifted from the transfer area 50 and separated.

In this case, as mentioned above, since the step 22 between the surfaces of each transfer mark M and base tape 15 functions as division bodily feeling means in collaboration with the leading end pressing portion 25 of the transfer head H, and the user can bodily feel through fingers, aside from visually recognizing the transfer division position of one transfer mark M, so that mishandling can be avoided effectively.

By this operation, the transfer mark M of the mark transfer tape T in the leading end pressing portion 25 of the transfer head H is peeled from the base tape 15, and transferred onto the transfer area 50, and the used mark transfer tape T after the transfer mark M is peeled off, that is, the base tape 15 is taken up and collected on the take-up reel 12.

Since the transfer mark M is an adhesive seal, instead of adhering and fixing the entire surface on the transfer area 50 by the mark transfer tool 1 as mentioned above, only part of the transfer mark M may be adhered and fixed provisionally on the transfer area 50 by the mark transfer tool 1, and the user can press the remaining portion directly by finger to fix (fix firmly).

The transfer mark M thus transferred can be handled same as a conventional adhesive seal, and, for example, the transferred transfer mark M maybe once peeled and adhered again like an adhesive seal, or peeled and removed when no longer necessary.

Since the mark transfer tool 1 of the embodiment has a cartridge structure so that the mark transfer tapes T can be exchanged, plural tape cartridges C having mark transfer tapes T of different kinds of transfer marks M, M, . . . may be prepared, and proper transfer marks M, M, . . . depending on the purpose can be transferred and used.

Figure 4A:
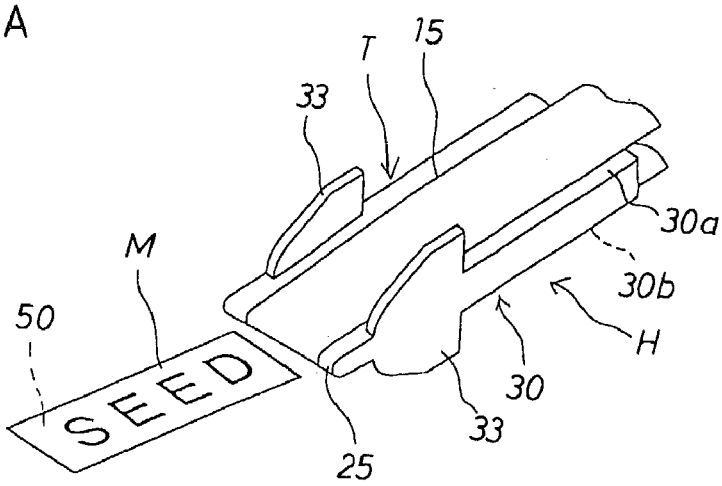
FIG. 4(*a*) is a perspective view of essential part of transfer head of the mark transfer tool.
Figure 4B:
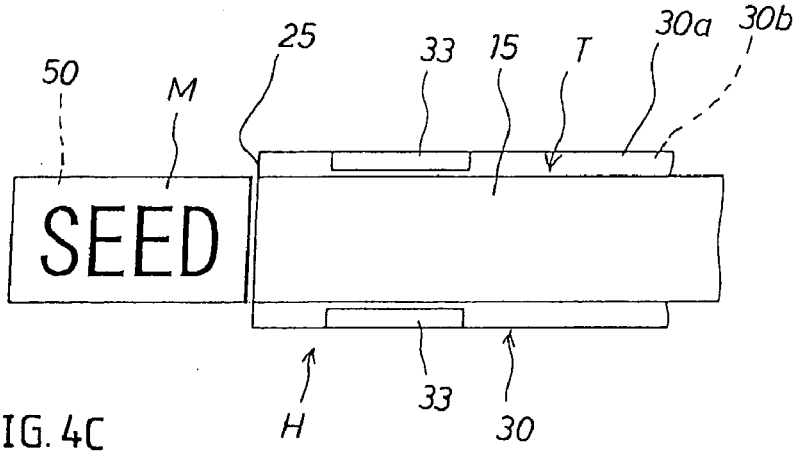
Figure 4C:
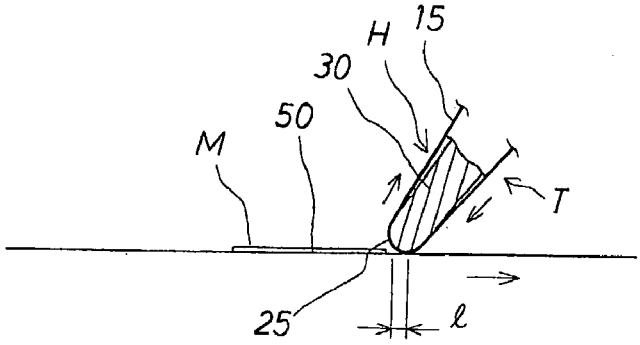

For example, types of marks composing transfer marks M include a character mark of letters (alphabetic letter mark SEED in the shown example) as shown in FIG. 4(*a*), FIG. 4(*c*), and FIG. 5(*a*), a decorative pattern mark as mentioned above (not shown), a mirror mark (not shown), and a graphic pattern mark (not shown), which may be properly selected and used.

Figure 7A:
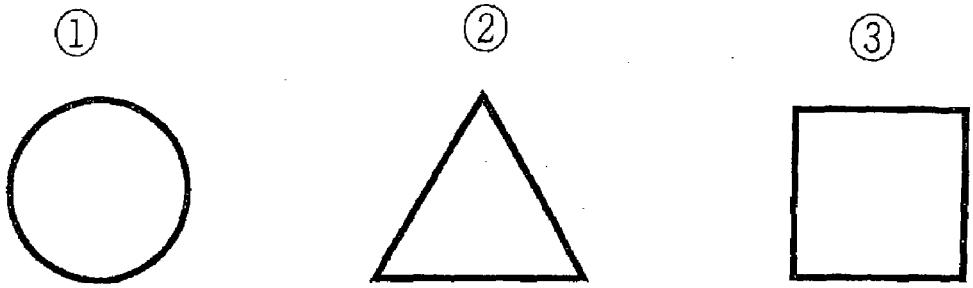
FIG. 7, consists of FIGS. 7A to 7C and are diagrams of specific examples of marks composing the transfer mark in the mark transfer tape.
Figure 7B:
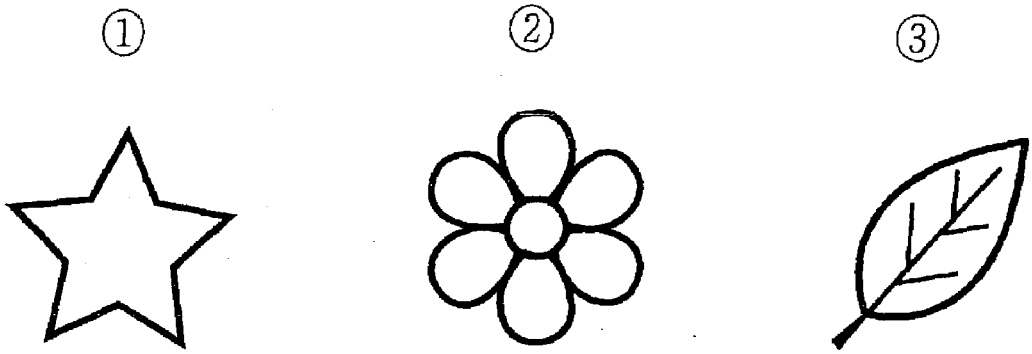
Figure 7C:
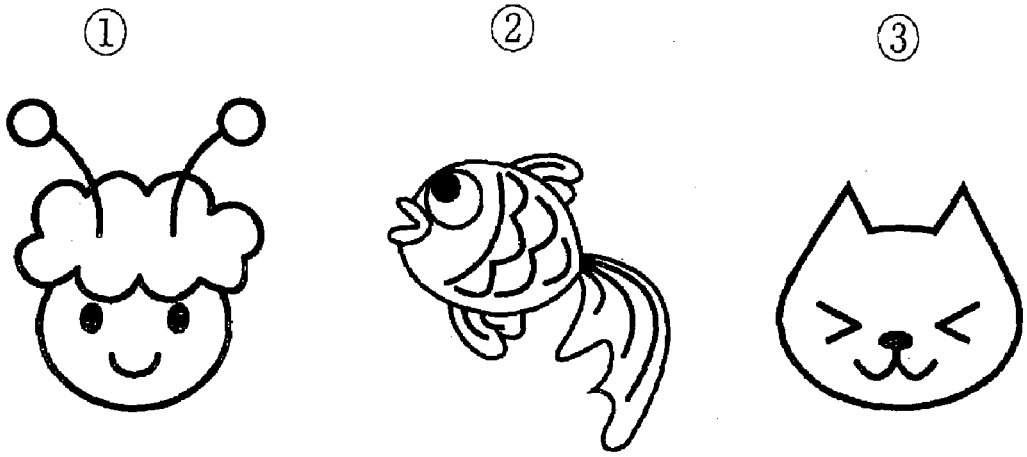

In particular, as specific examples of marks, various formats may be employed as shown in FIG. 7(*a*) to FIG. 7(*c*). Examples include geometrical diagrams as shown in FIG. 7(*a*) (1 to 3) (1. circular, 2. triangular, 3. square), or their colored ones, symbolic patterns as shown in FIG. 7(*b*) (1 to 3) (1. star, 2. flower, 3. leaf), or their colored ones, and figures as shown in FIG. 7(*c*) (1 to 3) (1. child, 2. goldfish, 3. kitten), or their colored ones.

Further, by containing an aromatic component in the constituent material of the transfer mark M, the transfer mark M may be prepared as aromatic seal having an aromatic effect, or by containing an antibacterial component, it may be prepared as antibacterial seal having an antibacterial effect, and by such constitution, in addition to the intrinsic marking effect of the mark, additional effects may be exhibited at the same time.

That is, the aromatic seal releases a comfortable fragrance, and has effects of recovery from fatigue, clearing of stress, and mental stability, and it can be, for example, effectively used in aromatherapy. Moreover, some of the aromatic components also have antibacterial effect, bactericidal effect, or insecticidal effect, and seals having such effects can be also prepared.

The antibacterial seal effectively suppresses growth of bacteria by antibacterial action, and it can be effectively used as mark to be adhered to office and household machine parts and switches handled by many people, such as operation switches of electrical appliances, hand-held type stationery items such as paper punch, or marker pen for whiteboard.

Such aromatic component and antibacterial component will be contained in at least one constituent material of the surface layer 20, mark layer 21, and pressure-sensitive adhesive layer 19 of the mark main body 18 for composing the transfer mark M.

Embodiment 2

Figure 10A:
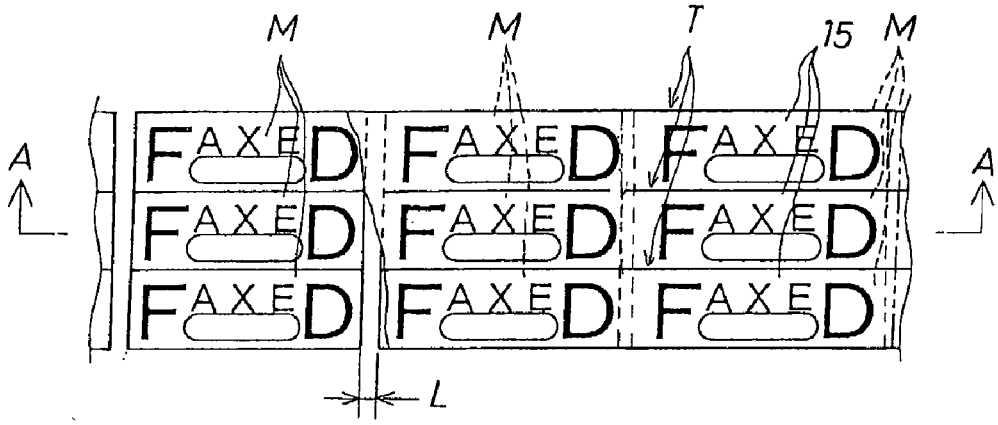
FIG. 10(*a*) is a partially cut-away plan view of the mark transfer tape in manufacturing process, showing the mark transfer tape of a mark transfer tool in embodiment 2 of the invention.
Figure 10B:
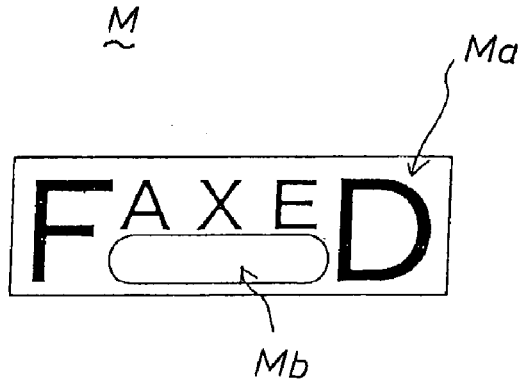
Figure 10C:
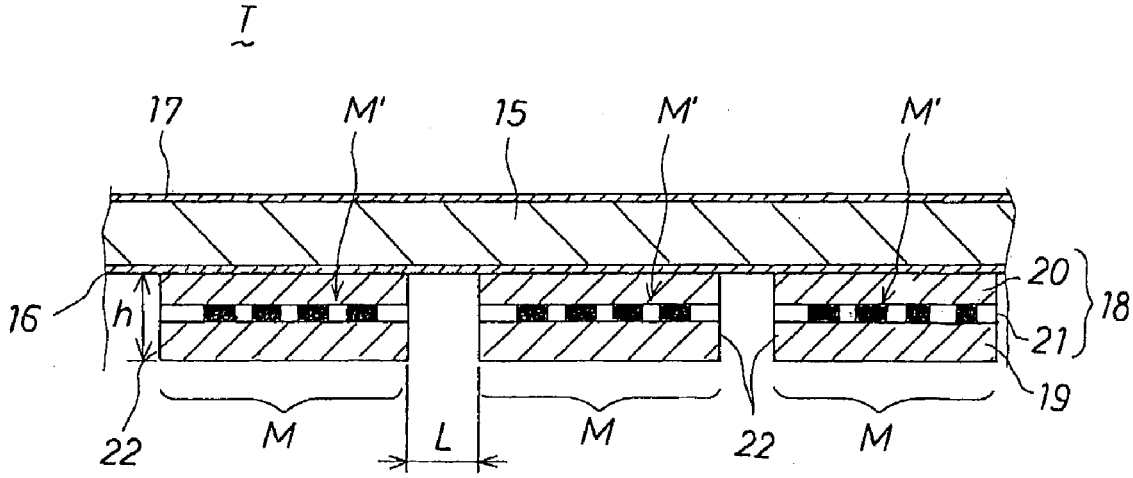
Figure 11A:
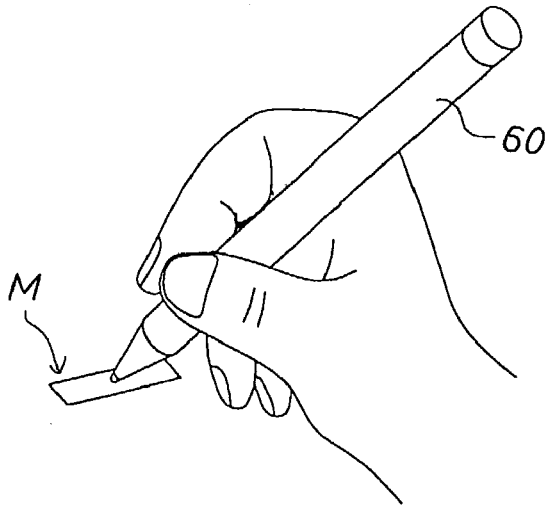
FIG. 11(*a*) is a perspective view showing an overwriting state by a writing tool after mark transfer of the mark transfer tool.
Figure 11B:
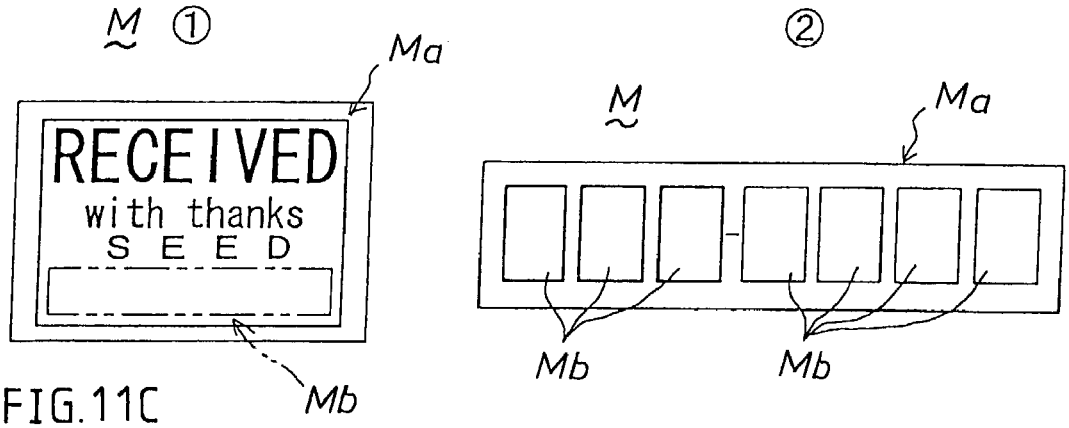
Figure 11C:
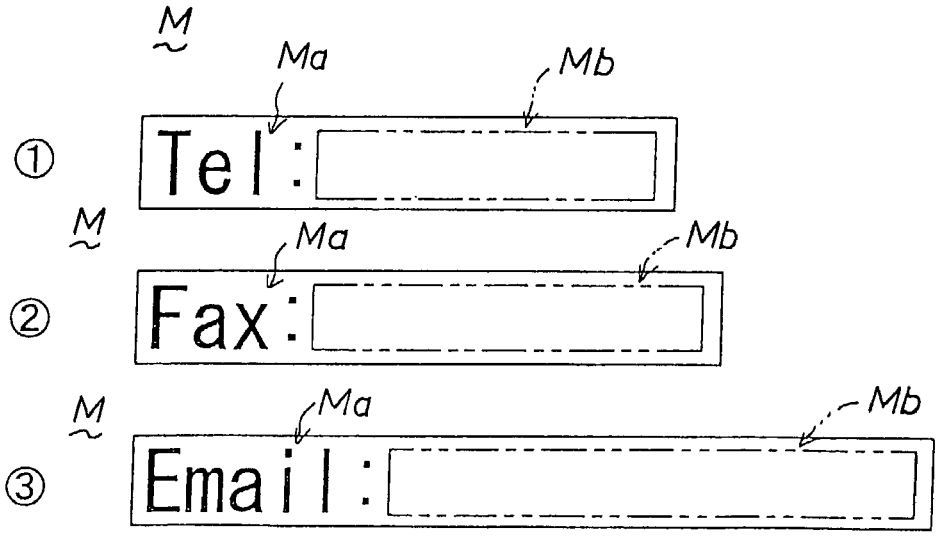

This embodiment is shown in FIG. 10(*a*) to FIG. 10(*c*), and FIG. 11(*a*) to FIG. 11(*c*), and it is slightly modified in structure from the mark transfer tape T in embodiment 1.

In the transfer tape T in embodiment 1, the transfer mark M is an indication mark only (alphabetic letter mark SEED in the shown example), but in the transfer tape T of this embodiment, the transfer mark M is composed of a mark Ma and an overwriting blank space Mb as shown in the drawing.

More specifically, as shown in FIG. 10(*b*), the mark Ma is a designed alphabetical letter FAXED, and the overwriting blank space Mb is a blank space matched in shape with the FAXED mark Ma (inside of a nearly elliptical frame), and the date is entered in this overwriting blank space Mb.

The mark Ma and overwriting blank space Mb form the mark layer 21 of the transfer mark M same as in embodiment 1.

That is, as shown in FIG. 10(*a*), the mark layer 21 is composed of multiple marks (composed of mark FAXED and overwriting blank space inside of a frame having a contour similar to an elliptical shape) M', M', M', . . . arrayed continuously and peelably at specific intervals in the running space of the base tape 15, and these marks M', M', M', . . . are formed on the surface layer 20 by any known printing technique as mentioned above.

The surface layer 20 has not only the basic functions as mentioned above (forming function of mark layer 21, and adhering and holding function of transfer mark M), but also the function of allowing overwriting by writing tool 60 such as ball-point pen on the overwriting blank space Mb, as the surface forming portion of transfer mark M after transfer of transfer mark M.

For this purpose, the constituent material of the surface layer 20 is a material capable of exhibiting such functions. The surface layer 20 of the embodiment is preferably composed of a resin material of so-called dry type suited to the surface layer after parting from the base tape 15, and having a transparency so as to be overwritten by a writing tool 60. If the constituent material of the surface layer 20 is not suitable to overwriting, at least the surface forming portion of the overwriting blank space Mb of the surface layer 20 should be treated to be suitable to overwriting by writing tool 60.

In the mark transfer tool 1 having such configuration, by the same transfer operation as explained in embodiment 1, after the transfer mark M on the mark transfer tape T is transferred on the transfer area 50, desired letters (date in the shown example) can be overwritten by writing tool 60 on the overwriting blank space Mb of the transfer mark M.

Thus, the transfer mark M is composed of the mark Ma and overwriting blank space Mb, and therefore it is possible to write on a position of a material not written directly by the writing tool 60 or a material not erased cleanly if once written.

The other configuration and operation are same as in embodiment 1.

Other examples of the transfer mark M (mark Ma and overwriting blank space Mb) are shown in FIG. 11(*b*) and FIG. 11(*c*).

That is, as shown in FIG. 11(*b*), same as mentioned above, the mark Ma and overwriting blank space Mb are integrated, in which ① is composed of mark Ma "RECEIVED with thanks SEED" and matching overwriting blank space Mb beneath it for entering the date.

Further, ② has a rectangular mark Ma with seven overwriting blank spaces Mb consisting of three cells enclosed with thick lines and four cells enclosed with thin lines for entering the Japanese postal system code (consisting of seven digits).

In FIG. 11(*c*), ① is the mark Ma (Tel:) followed by blank entry space Mb at the right side for entering the telephone number.

Next ② is the mark Ma (Fax:) followed by blank entry space Mb at the right side for entering the facsimile number.

Finally, ③ is the mark Ma (E mail:) followed by blank entry space Mb at the right side for entering the e-mail address.

Embodiment 3

Figure 12A:
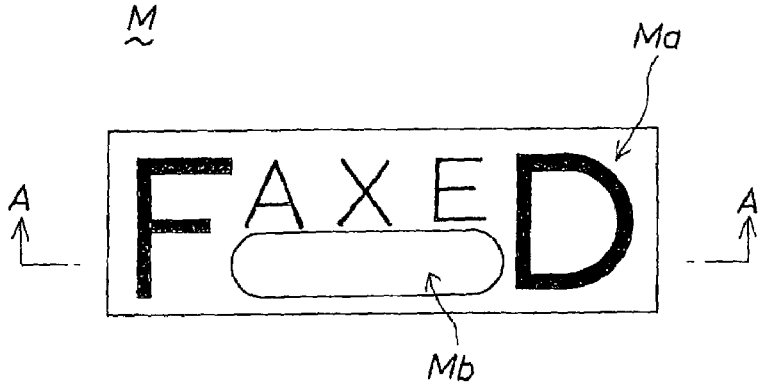
FIG. 12(*a*) is a magnified plan view of transfer mark in mark transfer tape of a mark transfer tape in embodiment 3 of the invention.
Figure 12B:
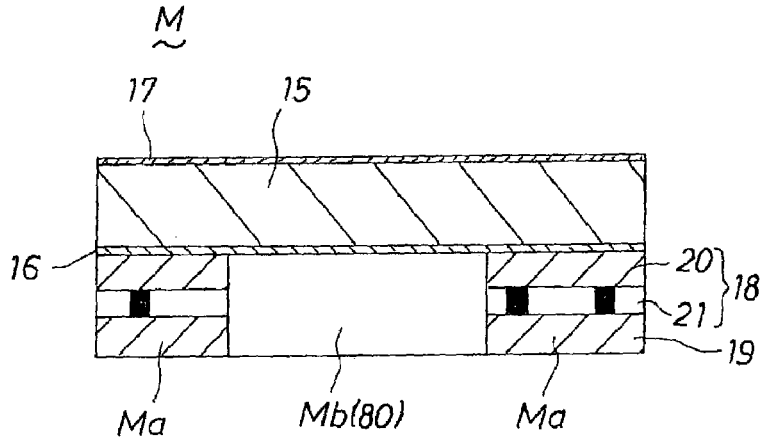
Figure 12C:
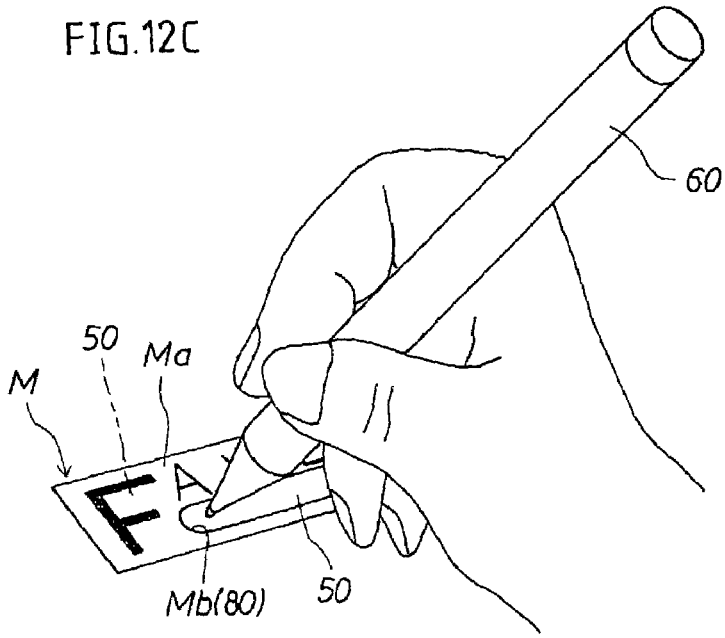

This embodiment is shown in FIG. 12(*a*) to FIG. 12(*c*), in which the specific structure of the mark transfer tape T in embodiment 2 is slightly modified.

That is, the transfer mark M is composed of the mark Ma and overwriting blanking space Mb same as in embodiment 2, but in the transfer mark M of this embodiment, the overwriting blank space Mb is formed as a writing window penetrating to the face and back sides of the transfer mark M as shown in FIG. 12(*b*)

Since the overwriting blank space Mb is formed as a writing window, it is suitable, for example, when the transfer area 50 is made of a material allowing direct writing by writing tool 60 and its base color is utilized effectively as the background color, or when the constituent material of the surface layer 20 of the transfer mark M is not suited to, or not allowing overwriting by writing tool 60.

The other configuration and operation are same as in embodiment 2.

Embodiment 4

Figure 13A:
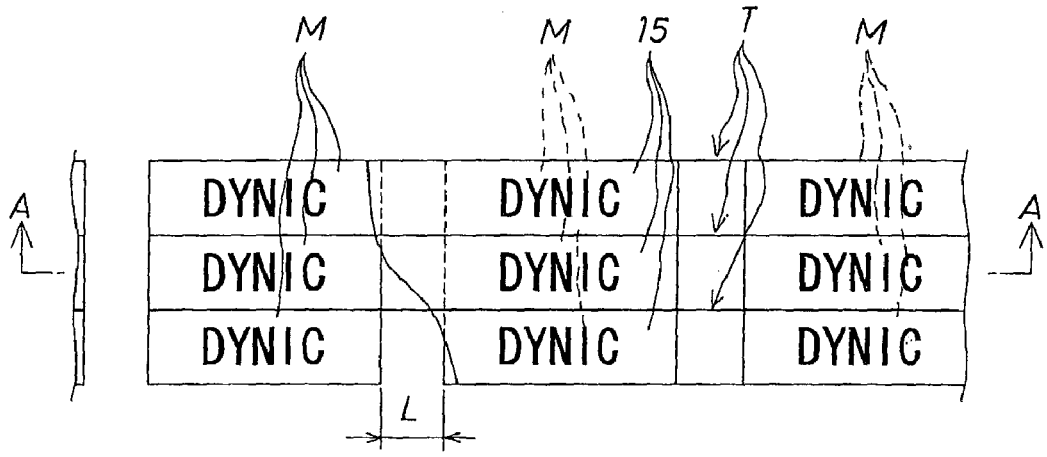
FIG. 13(*a*) is a partially cut-away plan view of the mark transfer tape in manufacturing process, showing the mark transfer tape of a mark transfer tool in embodiment 4 of the invention.
Figure 13B:
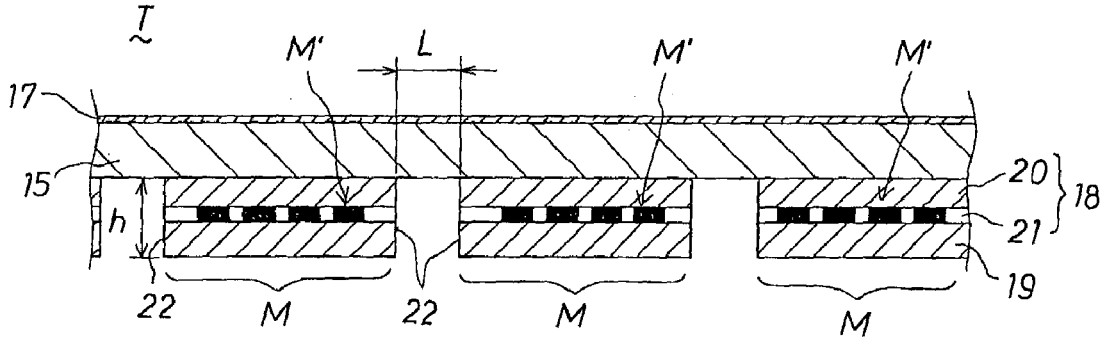
Figure 13C:
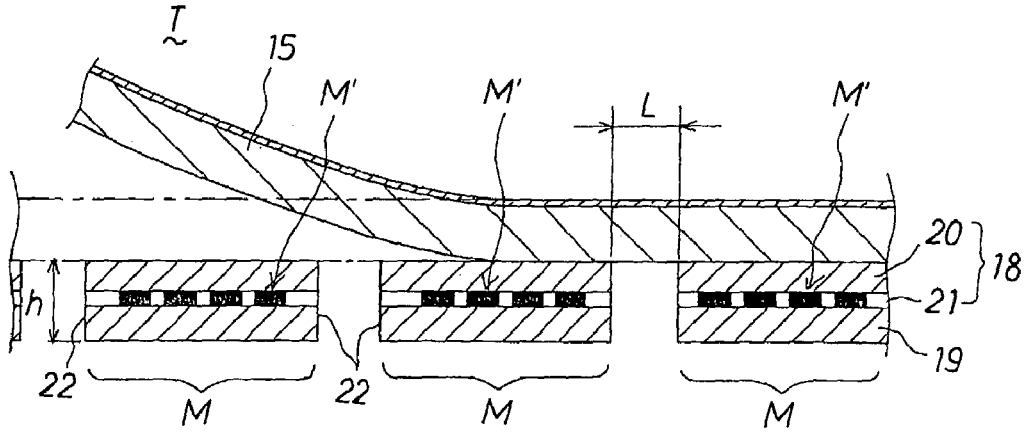

This embodiment is shown in FIG. 13(*a*) to FIG. 13(*c*), in which the specific structure of the mark transfer tape T in embodiment 1 is slightly modified.

That is, in the mark transfer tape T of this embodiment, the slight adhesive layer 16 in embodiment 1 is omitted, and transfer marks M, M, . . . are directly adhered and held on the surface of the base tape 15 to compose a laminated structure. The transfer mark M is composed of alphabetic mark DYNIC only.

Corresponding to this, the base tape 15 is preferably made of polyethylene terephthalate (PET) or polypropylene (PP) out of the constituent materials listed above, and the surface layer 20 of the mark main body 18 is preferably made of EVA, polyester, or other hot-melt resin.

The other configuration and operation are same as in embodiment 1.

Embodiment 5

Figure 14A:
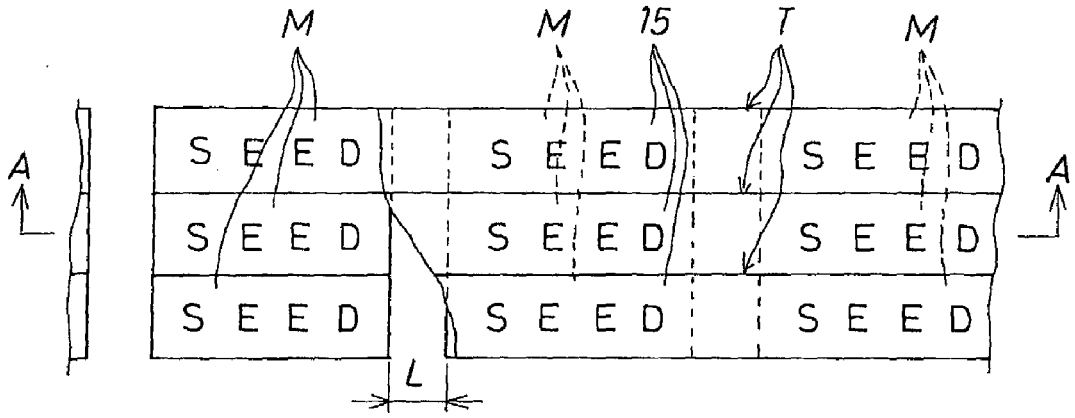
FIG. 14(*a*) is a partially cut-away plan view of the mark transfer tape in manufacturing process, showing the mark transfer tape of a mark transfer tool in embodiment 5 of the invention.
Figure 14B:
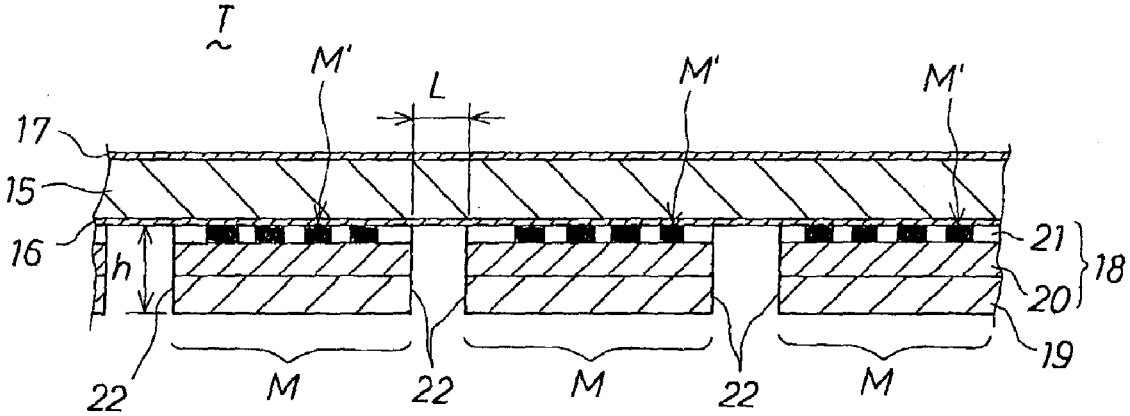
Figure 14C:
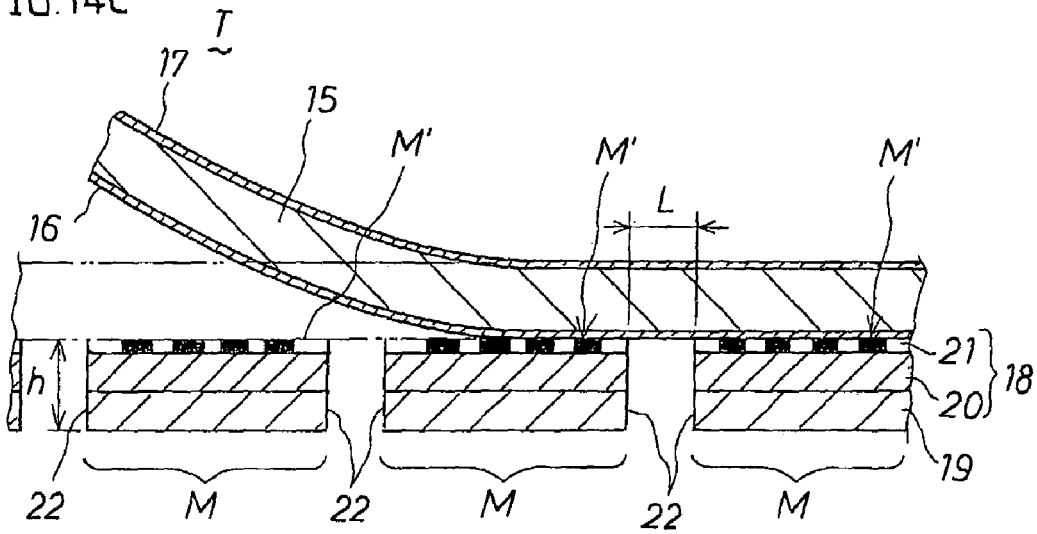

This embodiment is shown in FIG. 14(*a*) to FIG. 14(*c*), in which the specific structure of the mark transfer tape T in embodiment 1 is slightly modified.

That is, in the mark transfer tape T of this embodiment, the configuration of the surface layer 20 and mark layer 21 in the mark main body 18 in embodiment 1 is inverted, and the pressure-sensitive adhesive layer 19 is integrally laminated and formed on the surface layer 20. As a result, the transfer mark M is peelably adhered and held on the surface 16 of slight adhesive treatment of the base tape 16 by way of the mark layer 21.

The other configuration and operation are same as in embodiment 1.

Embodiment 6

Figure 15A:
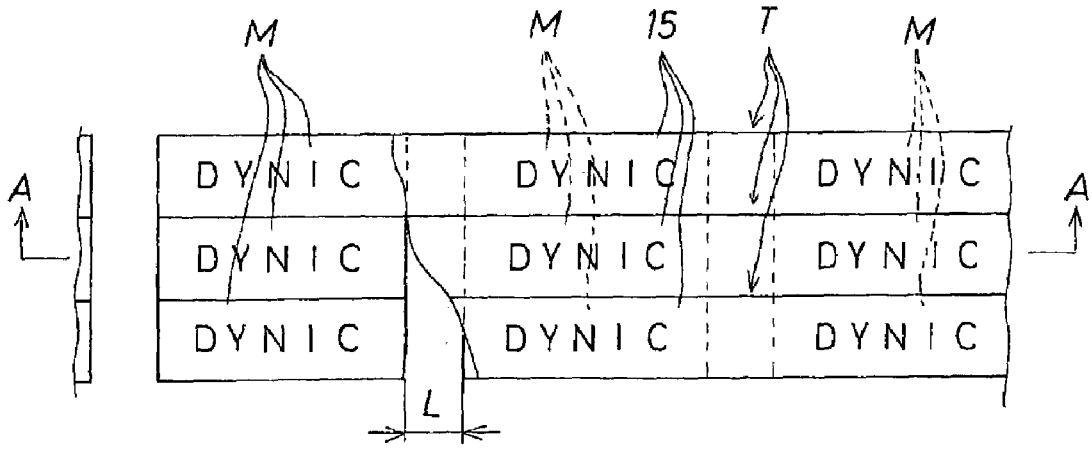
FIG. 15(*a*) is a partially cut-away plan view of the mark transfer tape in manufacturing process, showing the mark transfer tape of a mark transfer tool in embodiment 6 of the invention.
Figure 15B:
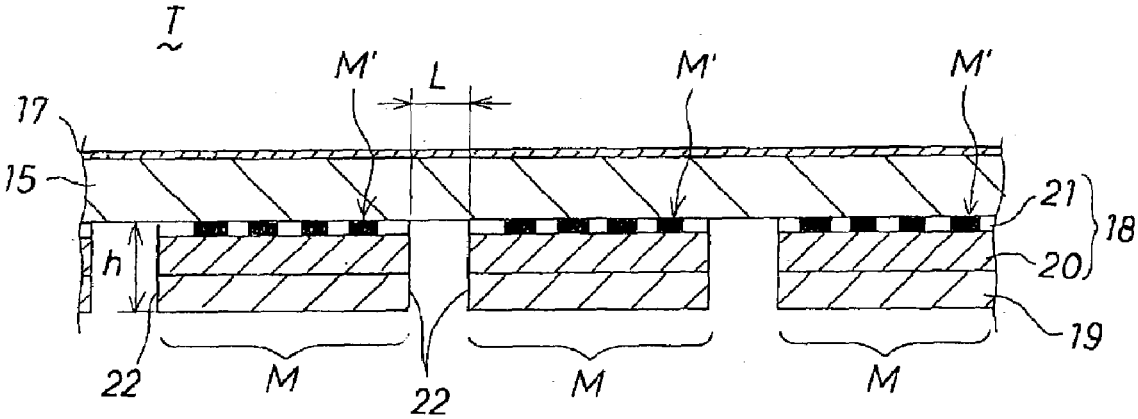
Figure 15C:
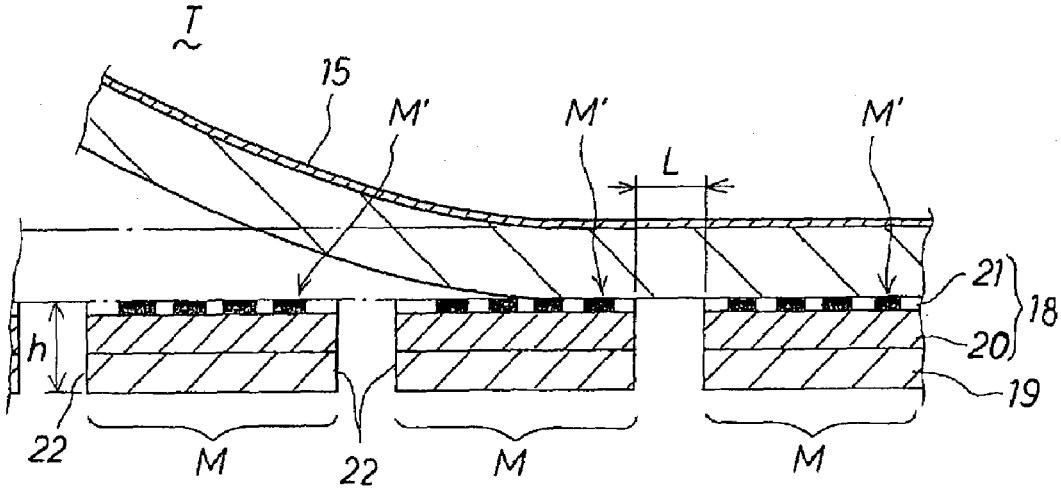

This embodiment is shown in FIG. 15(*a*) to FIG. 15(*c*), in which the specific structure of the mark transfer tape T in embodiment 5 is slightly modified.

That is, in the mark transfer tape T of this embodiment, same as in embodiment 4, the slight adhesive layer 16 in embodiment 5 is omitted, and transfer marks M, M, . . . are directly adhered and held on the surface of the base tape 15 to compose a laminated structure. The transfer mark M is composed of alphabetic mark DYNIC only.

Corresponding to this, the base tape 15 is composed same as in embodiment 4, and the mark layer 21 of the mark main body 18 is preferably made of EVA, polyester, or other hot-melt resin.

The other configuration and operation are same as in embodiment 5.

Embodiment 7

Figure 16A:
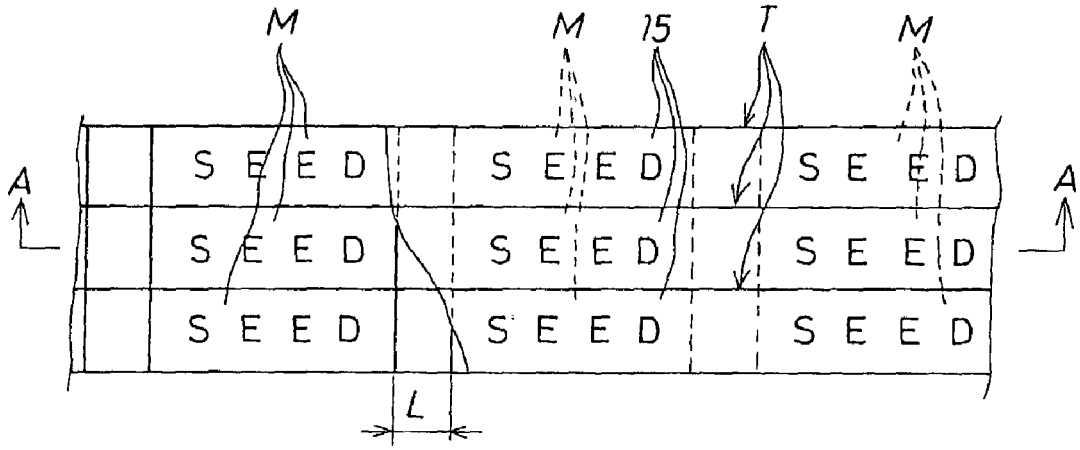
FIG. 16(*a*) is a partially cut-away plan view of the mark transfer tape in manufacturing process, showing the mark transfer tape of a mark transfer tool in embodiment 7 of the invention.
Figure 16B:
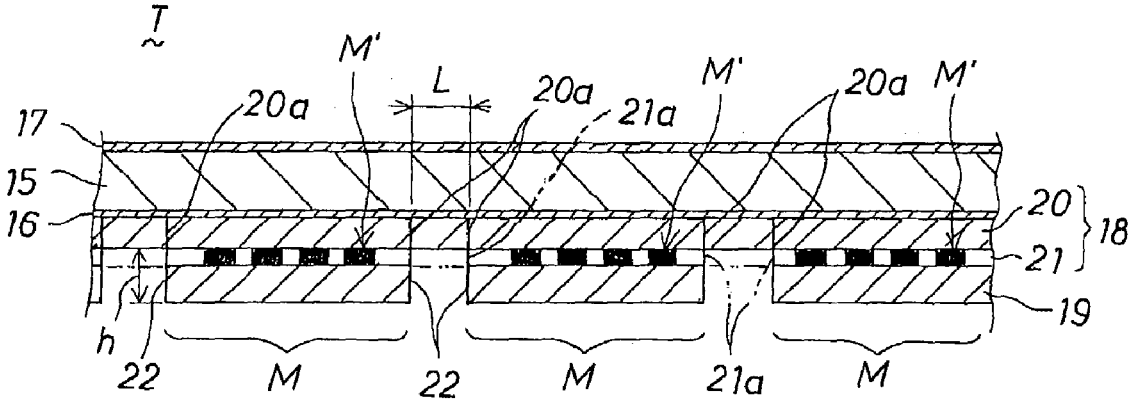
Figure 16C:
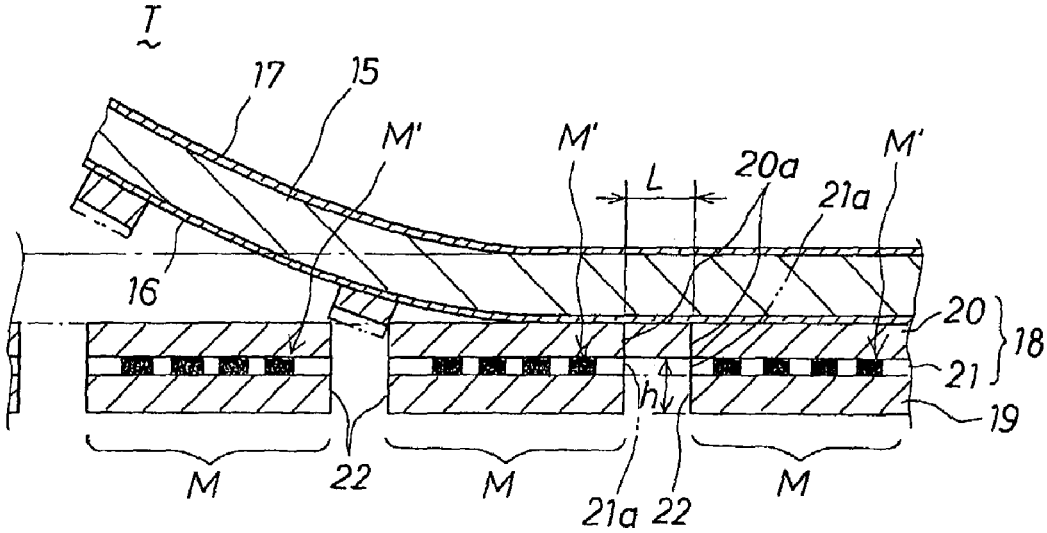

This embodiment is shown in FIG. 16(*a*) to FIG. 16(*c*), in which the specific structure of the mark transfer tape T in embodiment 1 is slightly modified.

That is, in the mark transfer tape T of this embodiment, the surface layer 20 in the mark main body 18 in embodiment 1 is a laminated structure formed continuously on the entire surface of the base tape 15.

Corresponding to this, cutting divisions 20*a* corresponding to both edges before and after the transfer mark M are extended and formed in the surface layer 20 linearly in the overall length of the base tape 15.

In the mark transfer tool 1 having such configuration, when transferring the transfer mark M on the mark transfer tape T on the transfer area 50, the surface layer 20 of the mark main body 18 is cut off in the shape conforming to the contour shape of the transfer mark M by the cutting division 20*a*, and therefore only the transfer mark M (the laminated structure of mark main body 18 and pressure-sensitive adhesive layer 19) is securely peeled off from the base tape 15, and is transferred and fixed on the transfer area 50.

In this embodiment, the division bodily feeling means composed of the step 22 between the surfaces of the transfer mark M and base tape 15 mentioned above and the leading end pressing portion 25 of the transfer head H acts more effectively, and mishandling can be effectively avoided.

In addition to the surface layer 20 of the mark main body 18, the mark layer 21 may be also formed, that is, the entire mark main body 18 may be formed continuously in a laminated structure on the entire surface of the base tape 15 as indicated by double dot chain line. In this case, when the transfer mark M on the mark transfer tape T is transferred on the transfer area 50, the entire mark main body 18 may be cut off in a shape conforming to the contour shape of the transfer mark M from the cutting divisions 20*a*, 21*a*.

The other configuration and operation are same as in embodiment 1.

Embodiment 8

Figure 17A:
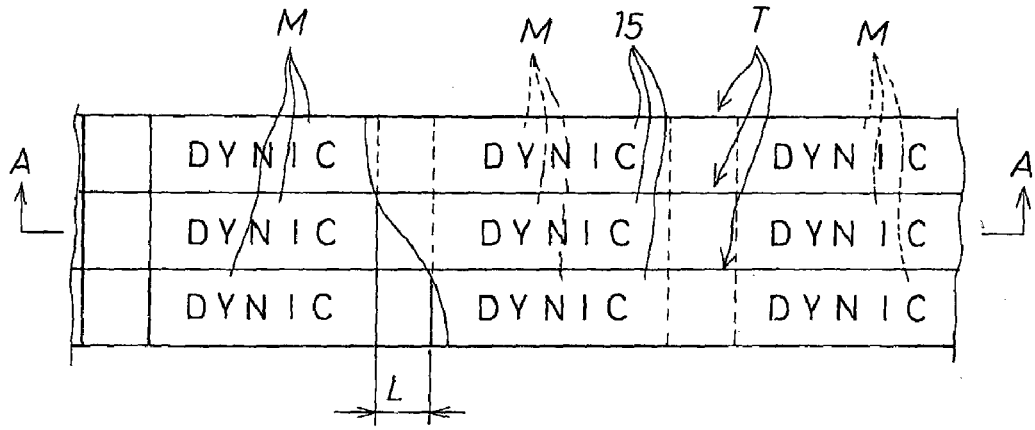
FIG. 17(*a*) is a partially cut-away plan view of the mark transfer tape in manufacturing process, showing the mark transfer tape of a mark transfer tool in embodiment 8 of the invention.
Figure 17B:
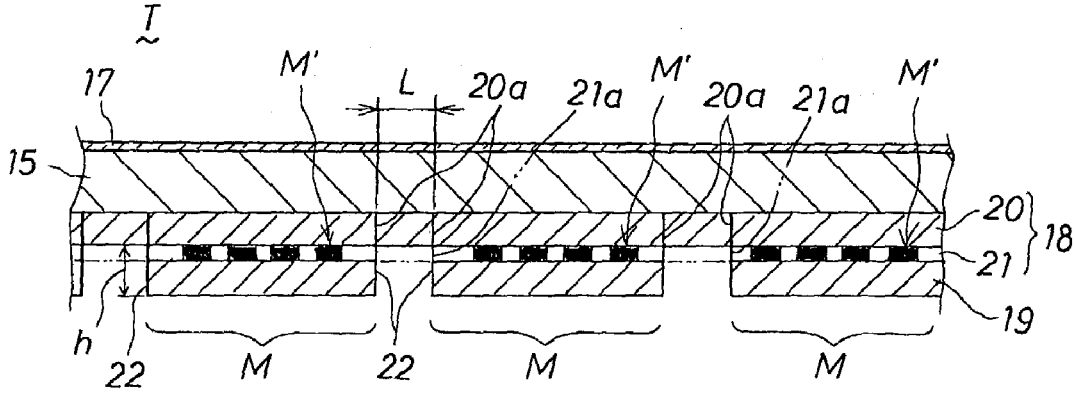
Figure 17C:
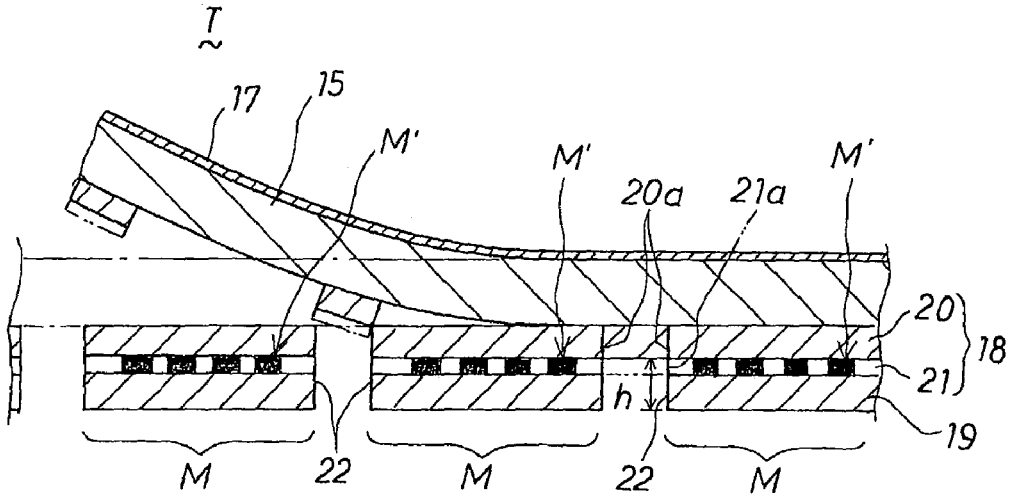

This embodiment is shown in FIG. 17(*a*) to FIG. 17(*c*), in which the specific structure of the mark transfer tape T in embodiment 7 is slightly modified.

That is, in the mark transfer tape T of this embodiment, same as in embodiment 4, the slight adhesive layer 16 in embodiment 7 is omitted, and transfer marks M, M, . . . are directly adhered and held on the surface of the base tape 15 to compose a laminated structure. The transfer mark M is composed of alphabetic mark DYNIC only.

Corresponding to this, the base tape 15 and the surface layer 20 of the mark main body 18 are composed same as in embodiment 4.

The other configuration and operation are same as in embodiment 7.

Embodiment 9

Figure 18A:
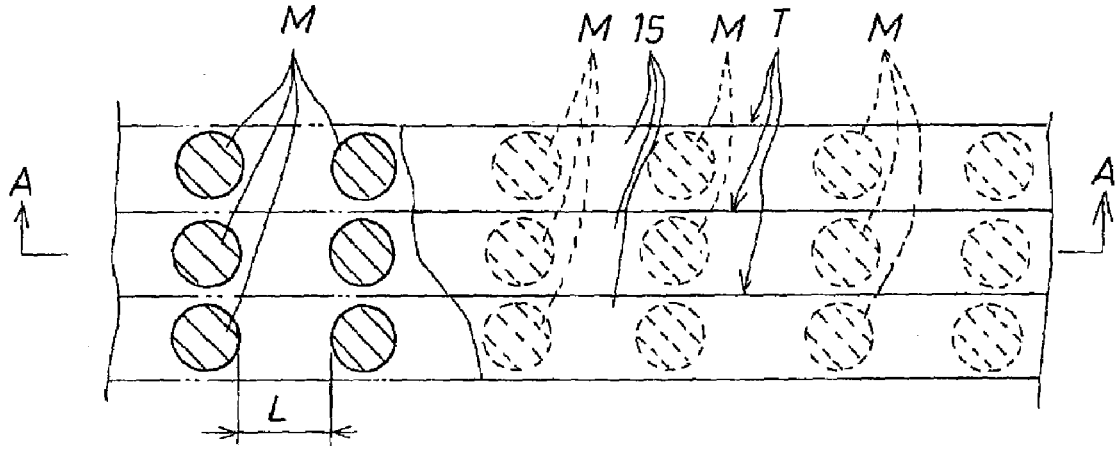
FIG. 18(*a*) is a partially cut-away plan view of the mark transfer tape in manufacturing process, showing the mark transfer tape of a mark transfer tool in embodiment 9 of the invention.
Figure 18B:
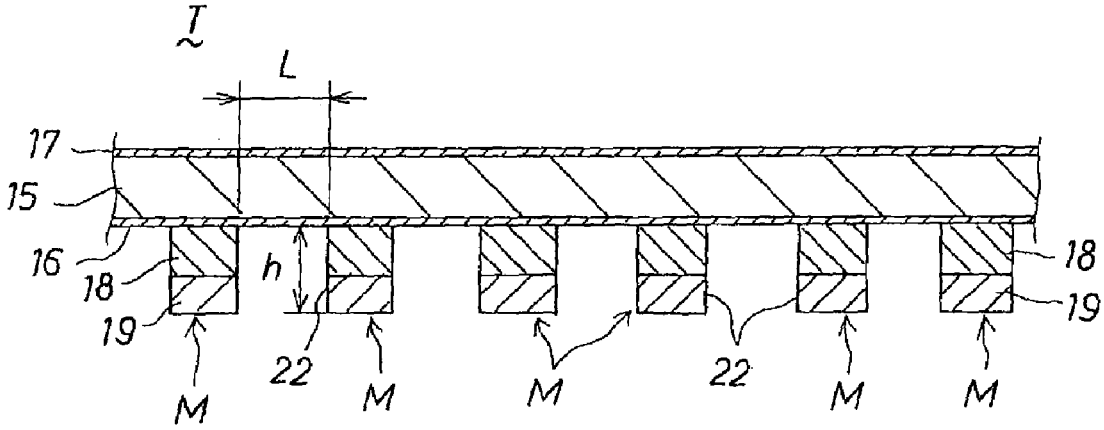

This embodiment is shown in FIG. 18(*a*) to FIG. 18(*c*), in which the specific structure of the mark transfer tape T is slightly modified.

That is, in the mark transfer tape T of the foregoing embodiments 1 to 8, the mark main body 18 of the transfer mark M is a two-layer laminated structure of surface layer 20 and mark layer 21, but in the mark transfer tape T of this embodiment, as shown in the drawing, the mark main body 18 of the transfer mark M is a single layer containing a coloring material, and its contour profile is circular, and a mark of the transfer mark M of the mark main body 18 formed of a single color or color pattern is composed.

More specifically, the constituent material of the mark main body 18 is same as the constituent of the surface material 20 mentioned above, being further blended with light diffusion agent or coloring matter (pigment or dyestuff), or metal foils or multiple small pieces for composing lame or other decorative pattern. Thus, the transfer mark M is formed as a circular seal of colored and translucent, colored and opaque, or other form with decorative pattern.

The contour profile shape of the transfer mark M is not limited to the circular pattern as shown in the drawing, but may include triangular, rectangular, polygonal, heart-shaped, stellate, or other irregular shape, or symbolic pattern as shown in FIG. 7(*b*) or figure pattern as shown in FIG. 7(*c*).

The other configuration and operation are same as in embodiment 1.

Embodiment 10

Figure 19A:
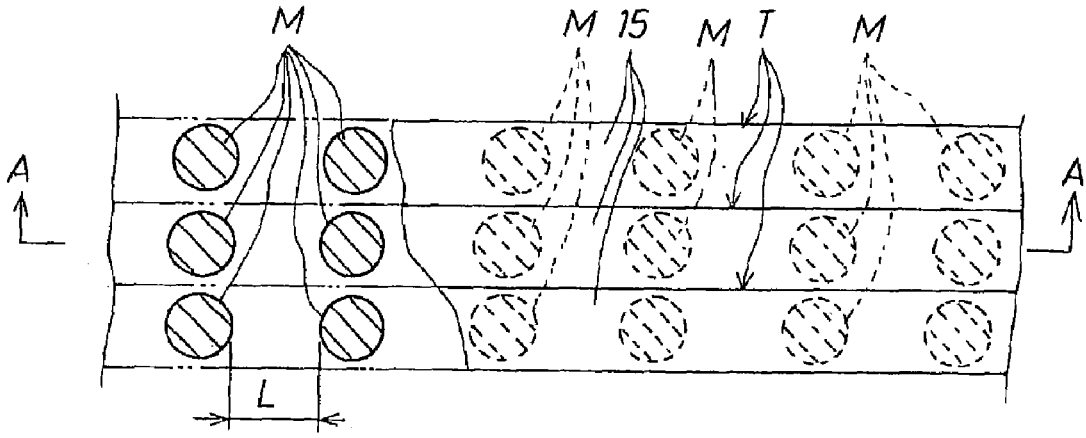
FIG. 19(*a*) is a partially cut-away plan view of the mark transfer tape in manufacturing process, showing the mark transfer tape of a mark transfer tool in embodiment 10 of the invention.
Figure 19B:
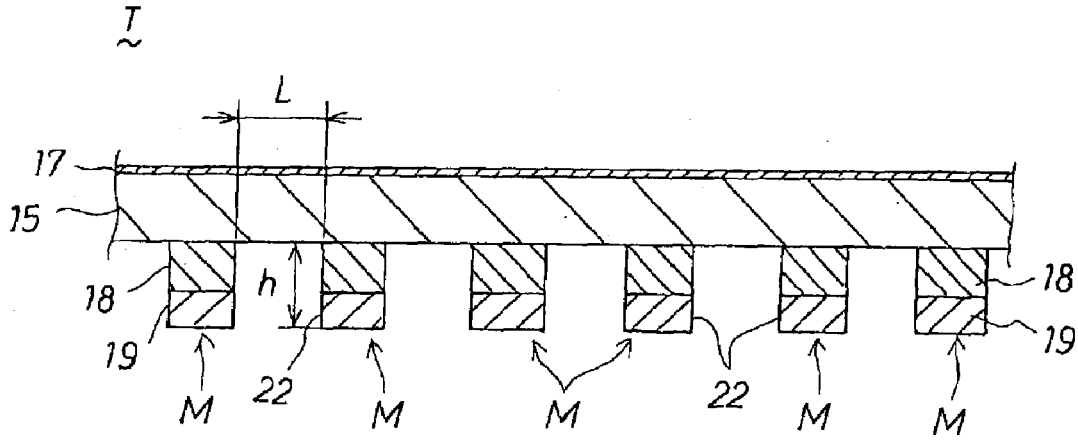
Figure 19C:
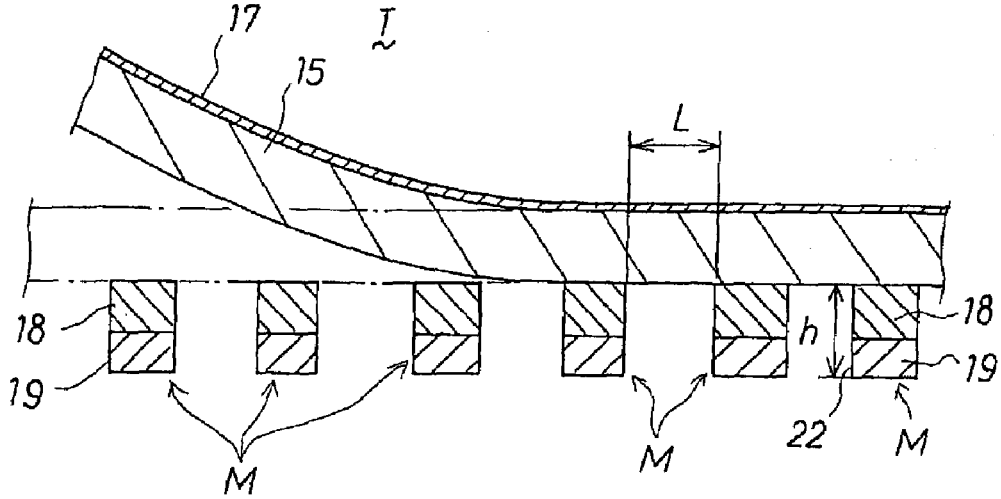

This embodiment is shown in FIG. 19(*a*) to FIG. 19(*c*), in which the specific structure of the mark transfer tape T in embodiment 9 is slightly modified.

That is, in the mark transfer tape T of this embodiment, the slight adhesive layer 16 in embodiment 9 is omitted, and transfer marks M, M, . . . are directly adhered and held on the surface of the base tape 15 to compose a laminated structure.

Corresponding to this, the base tape 15 is, same as in embodiment 4, preferably made of polyethylene terephthalate (PET) or polypropylene (PP) out of the constituent materials listed above, and the surface layer 20 of the mark main body 18 is preferably made of EVA, polyester, or other hot-melt resin, further blended with light diffusion agent or coloring matter (pigment or dyestuff).

The other configuration and operation are same as in embodiment 9.

Embodiment 11

Figure 20A:
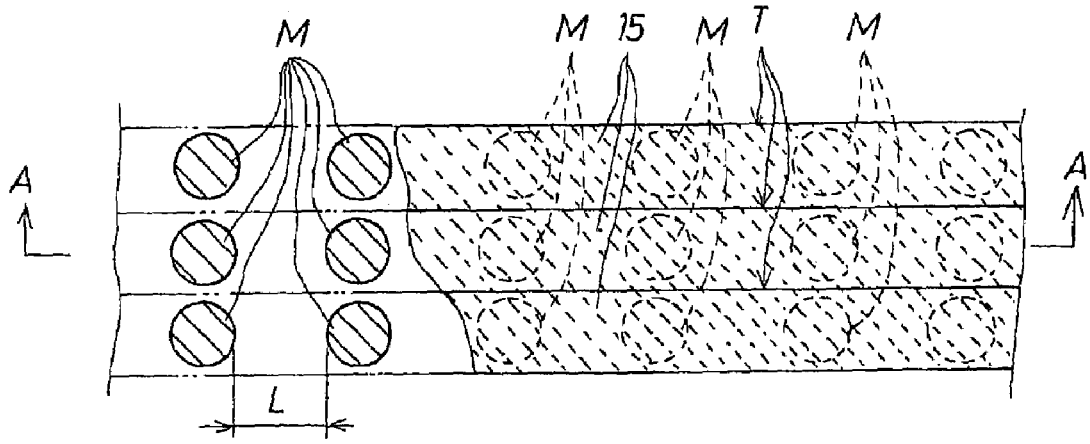
FIG. 20(*a*) is a partially cut-away plan view of the mark transfer tape in manufacturing process, showing the mark transfer tape of a mark transfer tool in embodiment 11 of the invention.
Figure 20B:
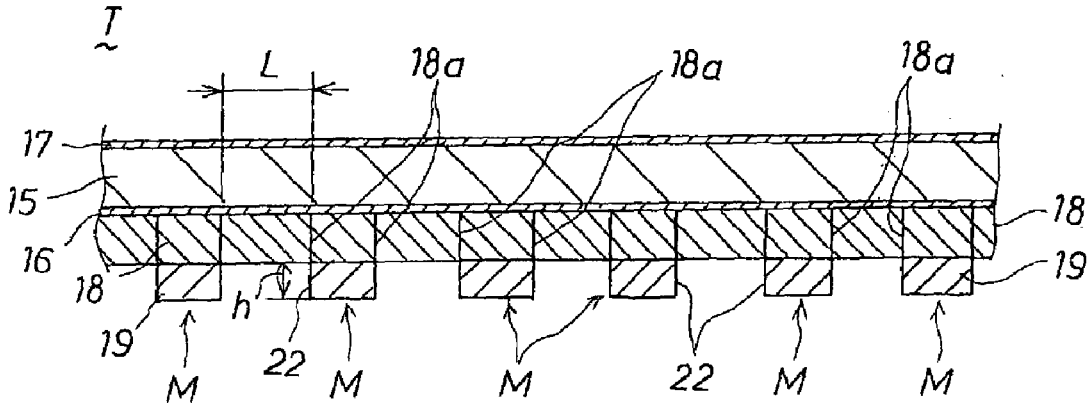
Figure 20C:
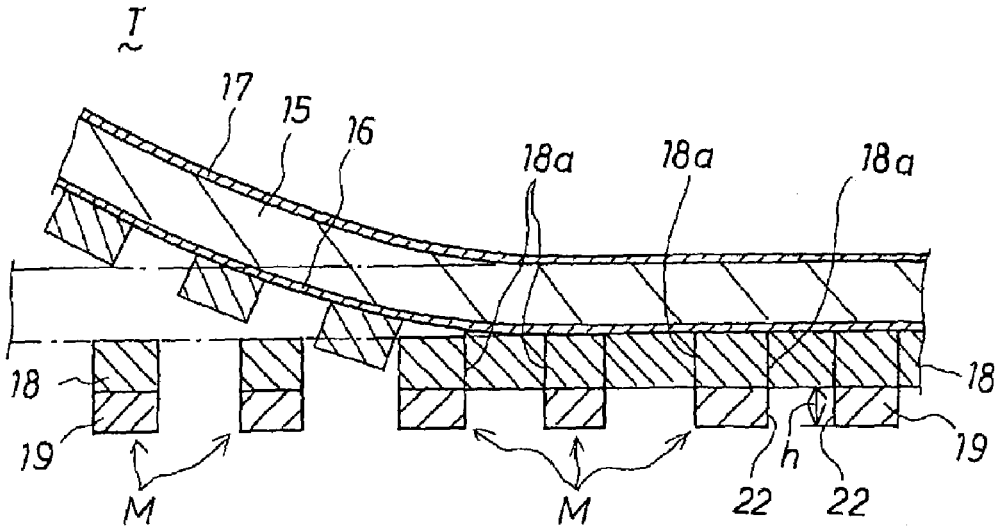

This embodiment is shown in FIG. 20(*a*) to FIG. 20(*c*), in which the specific structure of the mark transfer tape T in embodiment 9 is slightly modified.

That is, in the mark transfer tape T of this embodiment, the mark main body 18 in embodiment 9 is a laminated structure formed continuously on the entire surface of the base tape 15.

Corresponding to this, cutting divisions 18*a* corresponding to both edges before and after the transfer mark M are extended and formed in the mark main body 18 linearly in the overall length of the base tape 15.

In the mark transfer tool 1 having such configuration, when transferring the transfer mark M on the mark transfer tape T on the transfer area 50, the mark main body 18 is cut off in the shape conforming to the contour shape of the transfer mark M by the cutting division 18*a*, and therefore only the transfer mark M (the laminated structure of mark main body 18 and pressure-sensitive adhesive layer 19) is securely peeled off from the base tape 15, and is transferred and fixed on the transfer area 50.

In this embodiment, the division bodily feeling means composed of the step 22 between the surfaces of the transfer mark M and base tape 15 mentioned above and the leading end pressing portion 25 of the transfer head H acts more effectively, and mishandling can be effectively avoided.

The other configuration and operation are same as in embodiment 9.

Embodiment 12

Figure 21A:
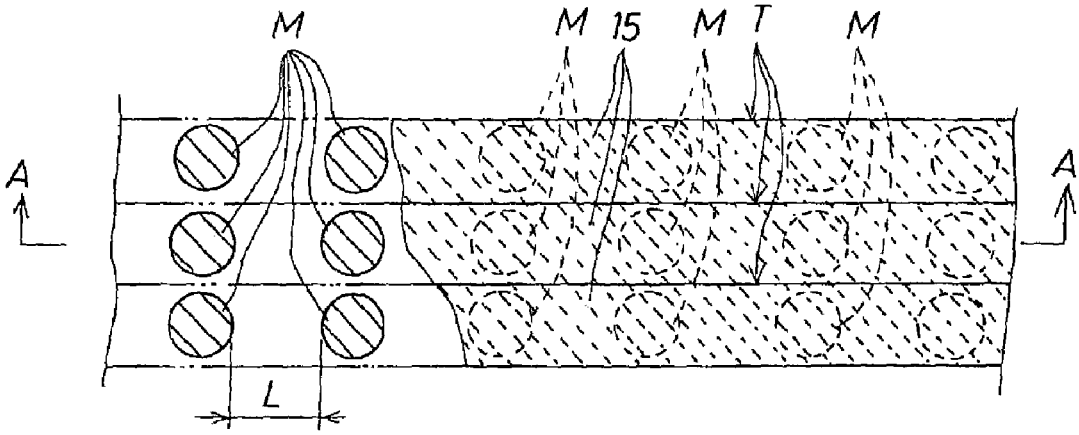
FIG. 21(*a*) is a partially cut-away plan view of the mark transfer tape in manufacturing process, showing the mark transfer tape of a mark transfer tool in embodiment 12 of the invention.
Figure 21B:
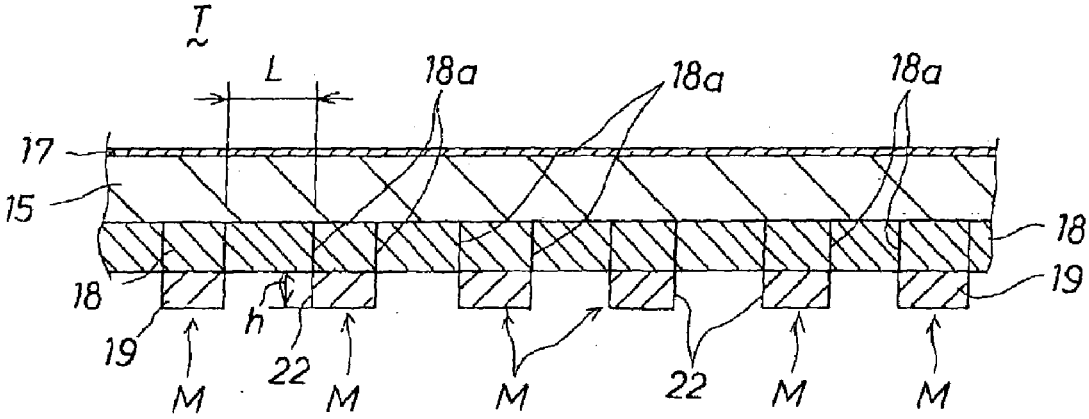
Figure 21C:
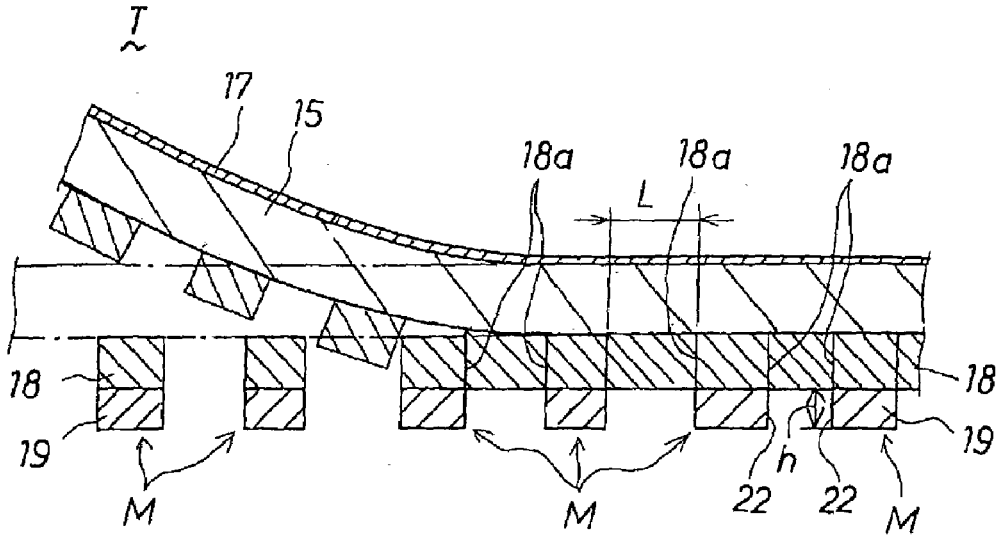

This embodiment is shown in FIG. 21(*a*) to FIG. 21(*c*), in which the specific structure of the mark transfer tape T in embodiment 11 is slightly modified.

That is, in the mark transfer tape T of this embodiment, same as in embodiment 10, the slight adhesive layer 16 in embodiment 11 is omitted, and transfer marks M, M, . . . are directly adhered and held on the surface of the base tape 15 to compose a laminated structure.

Corresponding to this, the base tape 15 and the mark main body 18 are composed of same materials same as in embodiment 10.

The other configuration and operation are same as in embodiment 11.

Embodiment 13

Figure 22A:
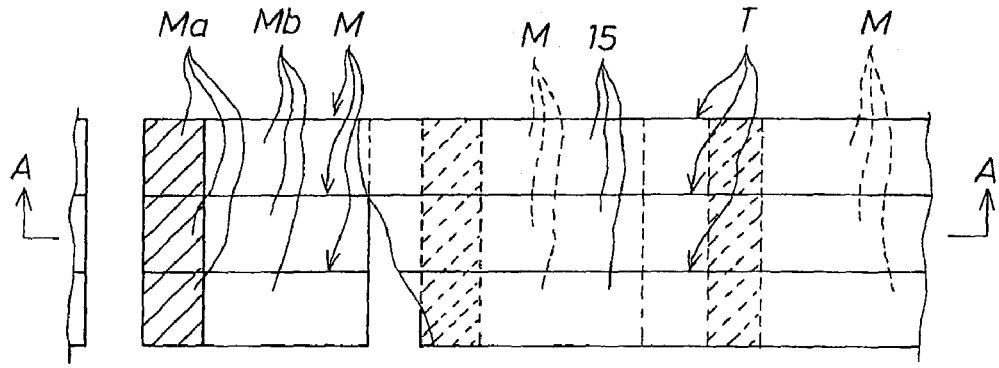
FIG. 22(*a*) is a partially cut-away plan view in manufacturing process of mark transfer tape of a mark transfer tool in embodiment 13 of the invention.
Figure 22B:
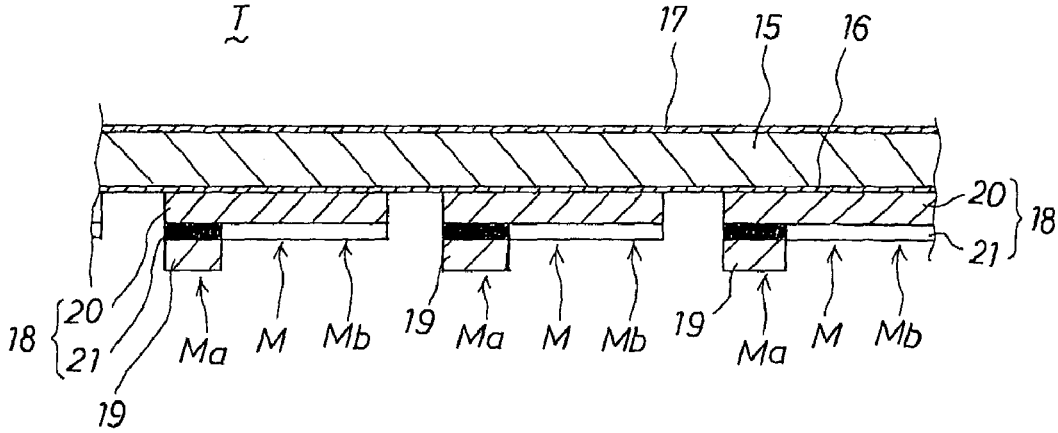
Figure 22C:
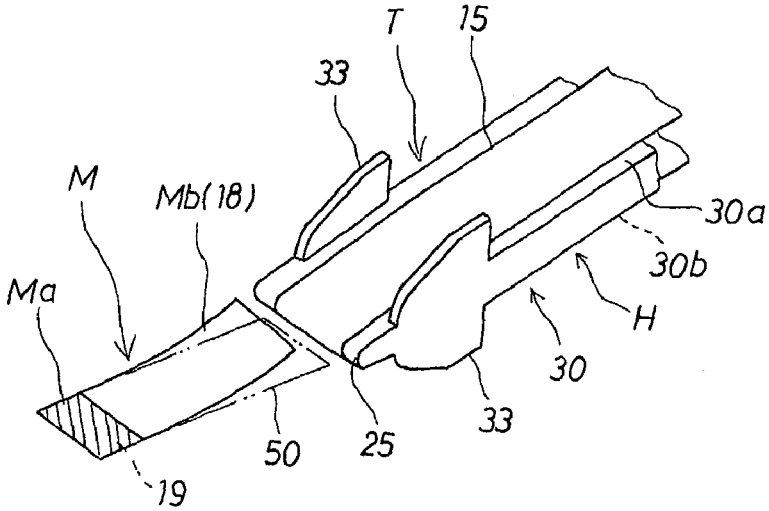

This embodiment is shown in FIG. 22(*a*) to FIG. 22(*c*), in which the specific structure of the mark transfer tape T is slightly modified.

That is, in the mark transfer tape T of the foregoing embodiments 1 to 12, the pressure-sensitive adhesive layer 19 of the transfer mark M is formed on the entire back side of the transfer mark M, and the entire surface of the transfer area 50 is adhered, that is, a form of contact seal is presented, while the transfer mark M of this embodiment is presented as an index seal as shown in FIG. 22(*b*), with the pressure-sensitive adhesive layer 19 formed only in the leading end portion in the longitudinal direction on the back side of the transfer mark M.

For this purpose, the adhesive force of the pressure-sensitive adhesive layer 19 is weaker than in the case of the contact seal, and is set stronger than the adhering and holding force on the base tape 15, and it is desired to have such property so as to be transferred and fixed on the transfer area 50 in ordinary state, and be peeled off easily from the transfer area 50.

The transfer mark M is composed of a mark Ma of a single color band or color pattern extended in the entire length in the width direction in the leading end position in the longitudinal direction, and a colorless or white overwriting blank space Mb, and this overwriting blank space Mb is used as a memo column for writing proper information characters or symbols.

Corresponding to this, the surface layer 20 of the mark main body 18 is preferably made of a resin material of so-called dry type suited to surface layer after parting from the base tape 15 and having transparency suited to overwriting by writing tool 60.

Therefore, in the mark transfer tool 1 having such configuration, by fitting the leading end pressing part 25 of the transfer head H tightly to the transfer start end of the transfer area 50, and movingly slightly in this state, only the leading end portion in the longitudinal direction of the transfer mark M on the mark transfer tape T is tightly fixed and transferred on the transfer area 50, and it can be used like an index seal as shown in FIG. 22(*c*), and therefore desired letters can be written on the overwriting blank space Mb of the transfer mark M by writing tool 60.

The other configuration and operation are same as in embodiment 1.

Embodiment 14

Figure 23:
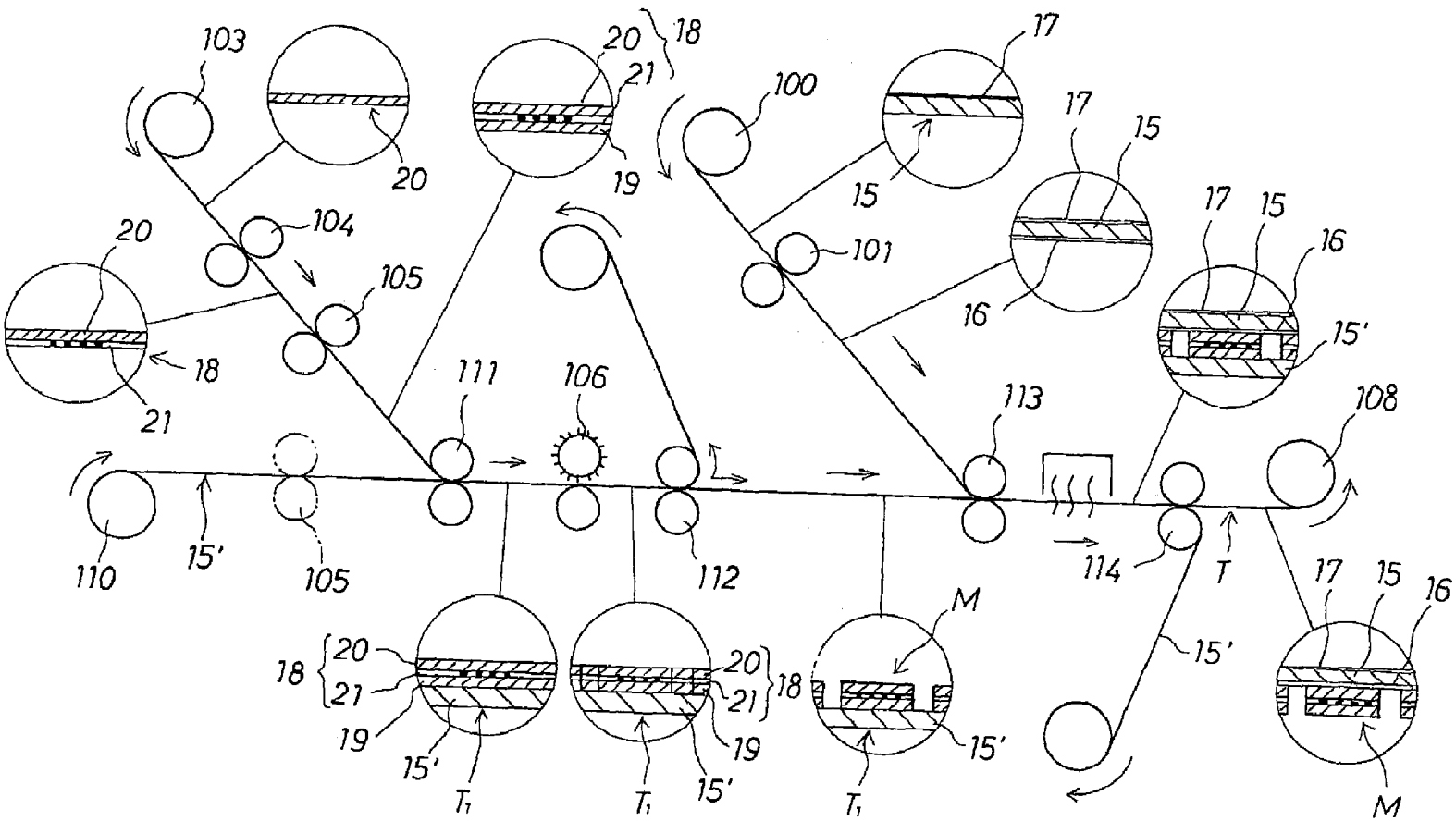
FIG. 23 is a schematic process diagram of manufacture of mark transfer tape of a mark transfer tool by die cutting method in embodiment 14 of the invention.

This embodiment is shown in FIG. 23, in which the manufacturing method of mark transfer tape T by die cutting method in embodiment 1 is modified.

That is, the manufacturing method in this embodiment is suited to a case of small thickness of, for example, base tape 15 of mark transfer tape T, and in embodiment 1, after laminating and forming the mark main body 18 and pressure-sensitive adhesive layer 19 on the base tape 15, it was processed by die cutting, but in this embodiment, the mark main body 18 and pressure-sensitive adhesive layer 19 are laminated and formed on a base tape for die cutting process, and after the die cutting process, transfer marks M, M, . . . formed by this die cutting process are laminated and formed on the surface of the base tape 15.

The series of manufacturing steps by die cutting method of the embodiment may be described as follows.

i) From a first base tape supply unit 110, paper-made base tapes 15' for die cutting having a preliminarily formed peelable surface are supplied continuously, and sent into a first laminating unit 111.

ii) From a surface layer supply unit 103, for example, PET tapes as surface layers 20 are supplied consecutively, and mark layers 21 are printed on the entire surface by a printing unit 104, and mark main bodies 18 are laminated and formed, and a pressure-sensitive adhesive layer 19 is formed thereon successively by an adhesive application unit 105, and the tapes are also sent into the first laminating unit 111.

iii) In the first laminating unit 111, the surface of the laminated tape composed of mark main body 18 (surface layer 20+mark layer 21) and pressure-sensitive adhesive layer 19, that is the pressure-sensitive adhesive layer 19 is laminated on the treated peelable surface of the base tape 15' for die cutting, and a prototype tape $T_1$ for die cutting of mark transfer tape T is formed, and sent into a die cutting unit 106.

iv) In the die cutting unit 106, cutting lines of specified transfer mark contour shapes are continuously formed by die cutting at specified intervals only on the laminated layer of the mark main body 18 and pressure-sensitive adhesive layer 19 of the prototype tape $T_1$ for die cutting.

v) From the prototype tape $T_1$ for die cutting processed by the die cutting unit 106, the laminated layers around the transfer mark contour shapes are peeled and removed by a first waste removal unit 112, and multiple transfer marks M, M, . . . are formed at specified intervals on the base tape 15' for die cutting, and the tape is sent into a second laminating unit 113.

vi) From a second base tape supply unit 100, for example, paper-made base tapes 15 preliminarily forming a peelable layer 17 on the back side are supplied consecutively, and a slight adhesive layer 16 is formed on the entire surface by a slight adhesion processing unit 101, and the tapes are sent into a second laminating unit 113.

vii) In the second laminating unit 113, on the surface forming the slight adhesive layer 16 of the base tape 15, back sides of multiple transfer tapes M, M, . . . formed on the base tape 15' for die cutting, that is, surface layers 20 are laminated, and the base tape 15' for die cutting is peeled and removed from the mark transfer tape T by a second waste removal unit 114, and a mark transfer tape T is completed, and taken up and collected in a completed tape container 108.

At step ii), meanwhile, the pressure-sensitive adhesive layer 19 is formed on the mark layer 21 printed and formed on the PET tape 20, but as indicated by virtual line, the pressure-sensitive adhesive layer 19 may be formed on the peelable surface of the base tape 15' for die cutting at step i), and in this case, in the first laminating unit 111, the mark main body 18 (surface layer 20+mark layer 21) is laminated on the pressure-sensitive adhesive 19 of the base tape 15' for die cutting, and thereby the prototype type $T_1$ for die cutting is formed.

The other configuration and operation are same as in embodiment 1.

Embodiment 15

Figure 24:
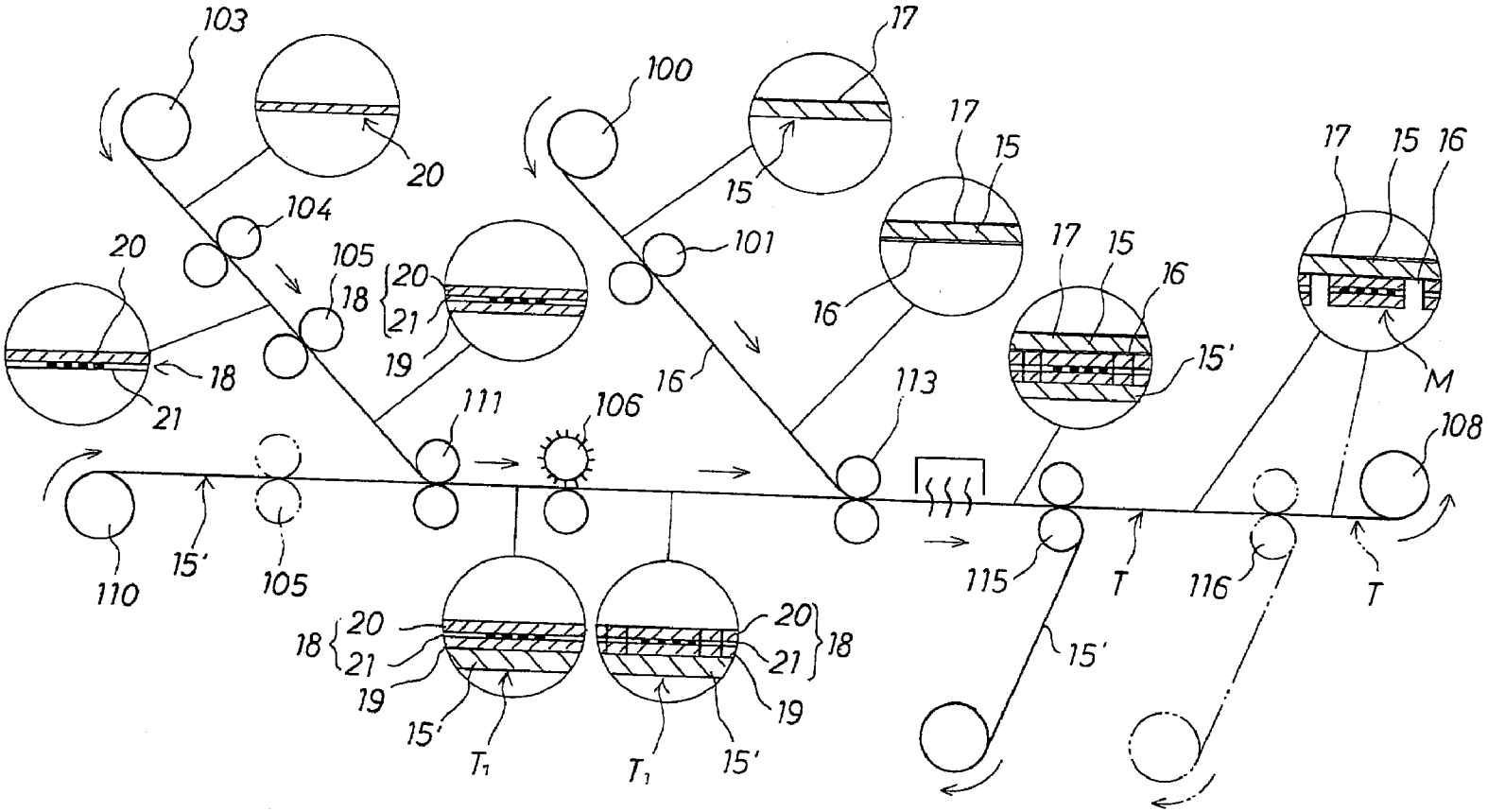
FIG. 24 is a schematic process diagram of manufacture of mark transfer tape of a mark transfer tool by die cutting method in embodiment 15 of the invention.

This embodiment is shown in FIG. 24, in which the manufacturing method of mark transfer tape T by die cutting method in embodiment 1 is modified.

That is, same as in embodiment 14, the manufacturing method in this embodiment is suited to a case of small thickness of, for example, base tape 15 of mark transfer tape T, and after die cutting by laminating and forming the mark main body 18 and pressure-sensitive adhesive layer 19 on other base tape for die cutting, transfer marks M, M, . . . formed by this die cutting process are laminated and formed on the surface of the base tape 15.

The series of manufacturing steps by die cutting method of the embodiment may be described as follows.

i) From a first base tape supply unit 110, paper-made base tapes 15' for die cutting having a preliminarily formed peelable surface are supplied continuously, and sent into a first laminating unit 111.

ii) From a surface layer supply unit 103, for example, PET tapes as surface layers 20 are supplied consecutively, and mark layers 21 are printed on the entire surface by a printing unit 104, and mark main bodies 18 are laminated and formed, and a pressure-sensitive adhesive layer 19 is formed thereon successively by an adhesive application unit 105, and the tapes are also sent into the first laminating unit 111.

iii) In the first laminating unit 111, the surface of the laminated tape composed of mark main body 18 (surface layer 20+mark layer 21) and pressure-sensitive adhesive layer 19, that is the pressure-sensitive adhesive layer 19 is laminated on the treated peelable surface of the base tape 15' for die cutting, and a prototype tape $T_1$ for die cutting of mark transfer tape T is formed, and sent into a die cutting unit 106.

iv) In the die cutting unit 106, cutting lines of specified transfer mark contour shapes are continuously formed by die cutting at specified intervals only on the laminated layer of the mark main body 18 and pressure-sensitive adhesive layer 19 of the prototype tape $T_1$ for die cutting.

v) From a second base tape supply unit 100, for example, paper-made base tapes 15 preliminarily forming a peelable layer 17 on the back side are supplied consecutively, and a slight adhesive layer 16 is formed on the entire surface by a slight adhesion processing unit 101, and the tapes are sent into a second laminating unit 113.

vi) In the second laminating unit 113, on the surface forming the slight adhesive layer 16 of the base tape 15, the laminated layer of the mark main body 18 and pressure-sensitive adhesive layer 19 on the base tape 15' for die cutting processed by die cutting at step iv) is laminated and formed, and the laminated layer around the transfer mark contour shape is peeled and removed from the base tape 15, together with the base tape 15' for die cutting, by a waste removal unit 115, and a mark transfer tape T is completed, and taken up and collected in a completed tape container 108.

In the waste removal unit 115, only the die cutting tape 15' may be peeled and removed from the base tape 15, and by a second waste removal unit 116, the laminated layer around the transfer mark contour shape may be peeled and removed from the base tape 15, and the mark transfer tape T may be completed.

Instead of step ii), the pressure-sensitive adhesive layer 19 maybe formed at step i) same as in embodiment 14 as indicated by virtual line.

The other configuration and operation are same as in embodiment 1.

Embodiment 16

Figure 25:
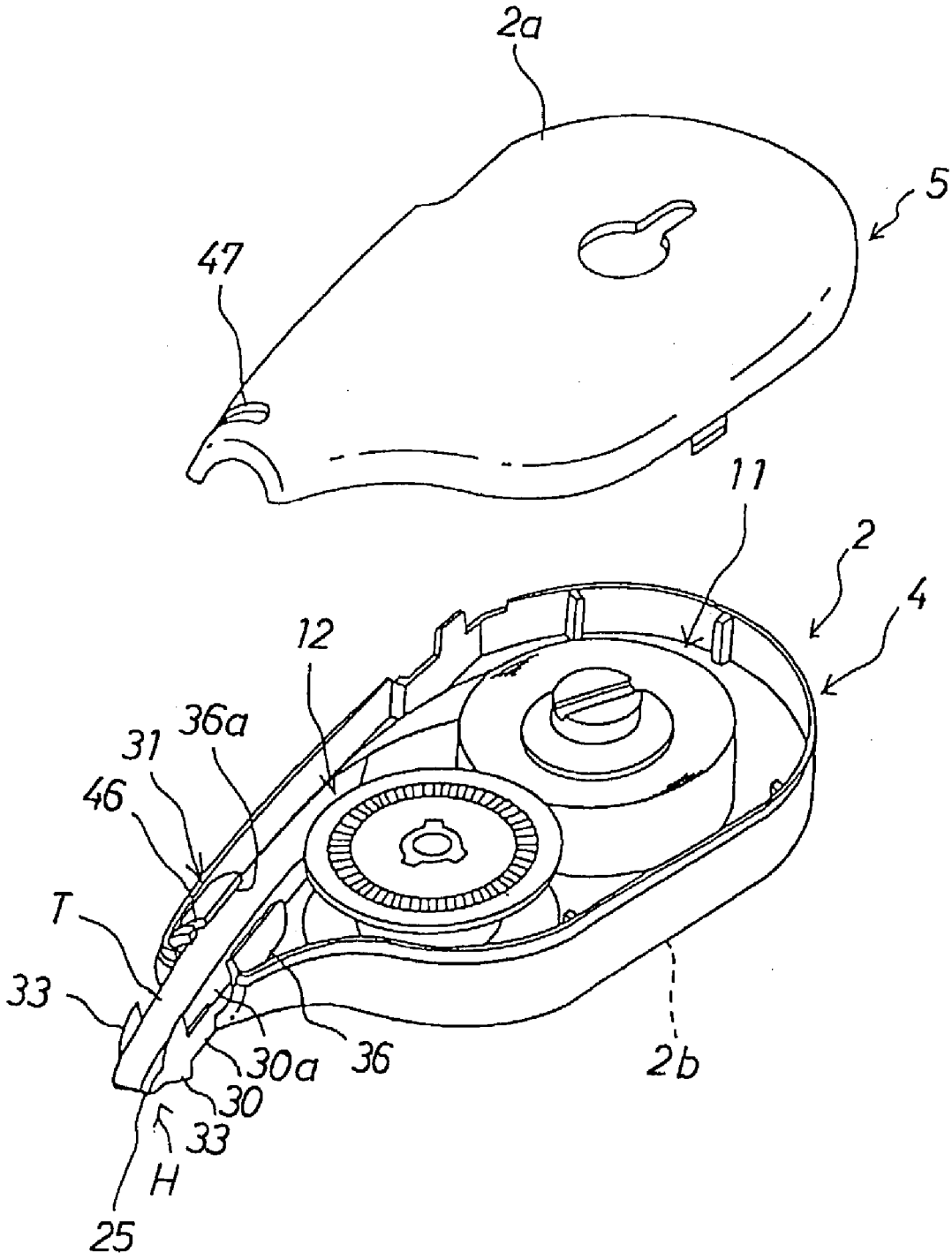
FIG. 25 is a perspective exploded view of a mark transfer tool in embodiment 16 of the invention.

This embodiment is shown in FIG. 25, in which the basic structure of the mark transfer tool 1 is modified.

That is, in the mark transfer tool 1 of the foregoing embodiments, the mark transfer tape T as a consumable part is an exchangeable cartridge type, that is, refill type, whereas this embodiment presents a one-time disposable type, that is, all component parts including the mark transfer tape T are consumable parts.

In the mark transfer tool 1 of the embodiment, in a hand-held case 2, a payoff reel 11 on which a mark transfer tape T is wound, and a take-up reel 12 for collecting the mark transfer tape T after use are installed, and a transfer head H is disposed at the leading end of the case 2 so as to be rotatable about its head axial center. The specific structure of the transfer head H is same as in embodiment 1, except for its mounting position.

Although not shown specifically, in the case main body 4 of the case 2, aside from the payoff reel 11 and take-up reel 12, a tape interlock unit for mutually interlocking these reels 11, 12, a clutch mechanism for synchronizing the payoff speed and take-up speed of the mark transfer tape T by the payoff reel 11 and take-up reel 12, and other principal and basic mechanical parts are also assembled in a unit.

The other configuration and operation are same as in embodiment 1.

Embodiment 17

Figure 26A:
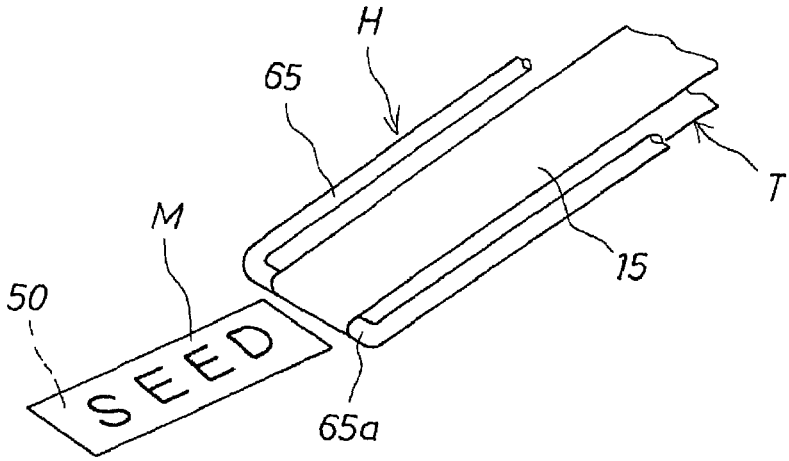
FIG. 26(*a*) is a perspective view of essential parts of transfer head of a mark transfer tool in embodiment 17 of the invention.
Figure 26B:
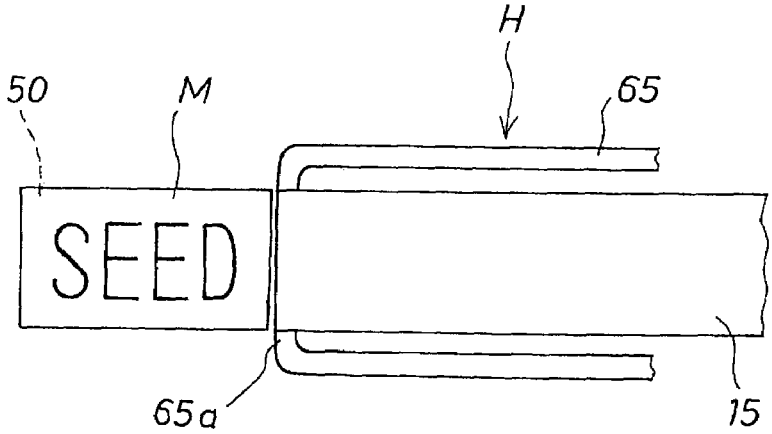
Figure 26C:
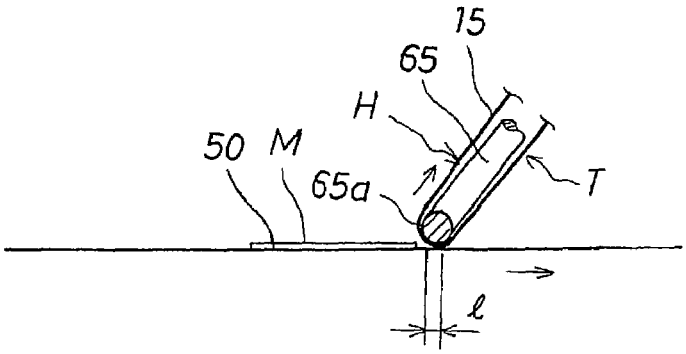

This embodiment is shown in FIG. 26(*a*) to FIG. 26(*c*), in which the structure of the transfer head H of the mark transfer tape T is modified.

That is, the transfer head H of the embodiment is formed like a wire head as shown in the drawing. More specifically, in this transfer head H, a proper flexible wire 65 of metal or stainless steel is folded and formed in a rectangular shape as shown in FIG. 26(*a*) and FIG. 26(*b*). The straight portion 65*a* at its leading end is a linear leading end pressing portion for pressing the mark transfer tape onto the transfer area 50.

The other configuration and operation are same as in embodiment 1.

Embodiment 18

Figure 27A:
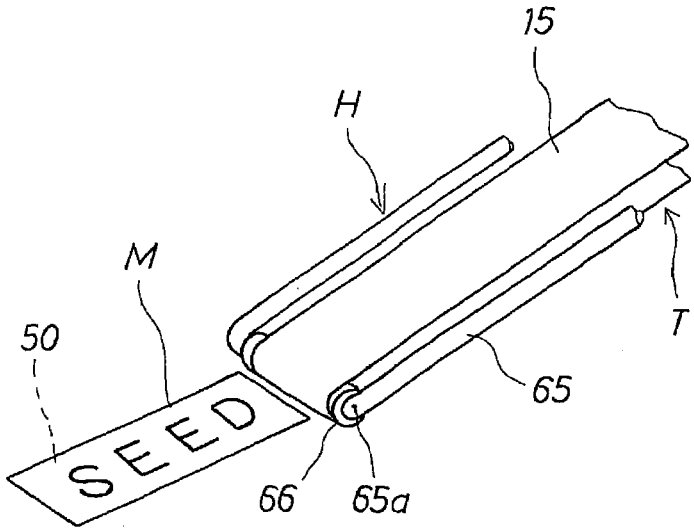
FIG. 27(*a*) is a perspective view of essential parts of transfer head of a mark transfer tool in embodiment 18 of the invention.
Figure 27B:
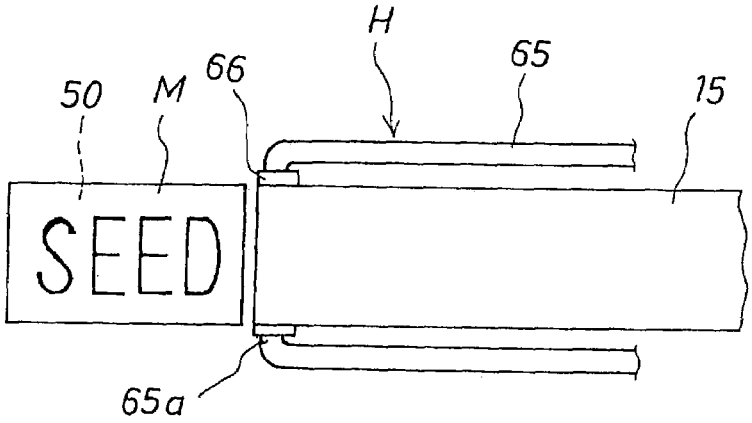
Figure 27C:
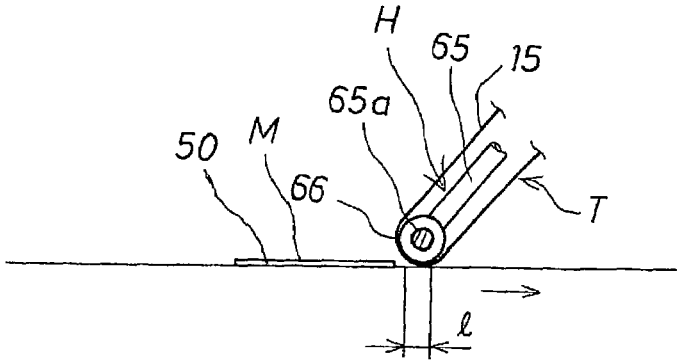

This embodiment is shown in FIG. 27(*a*) to FIG. 27(*c*), in which the structure of the transfer head H in embodiment 16 is slightly modified.

That is, the transfer head H of the embodiment is a wire head same as in embodiment 16, and more specifically a pressing cylindrical body 66 is provided in the linear leading end pressing portion 65*a*. This pressing cylindrical body 66 is a thin cylindrical piece made of metal or elastic material, and is fixed or rotatably disposed in the leading end pressing portion 65*a*.

The other configuration and operation are same as in embodiment 16.

Embodiment 19

Figure 28A:
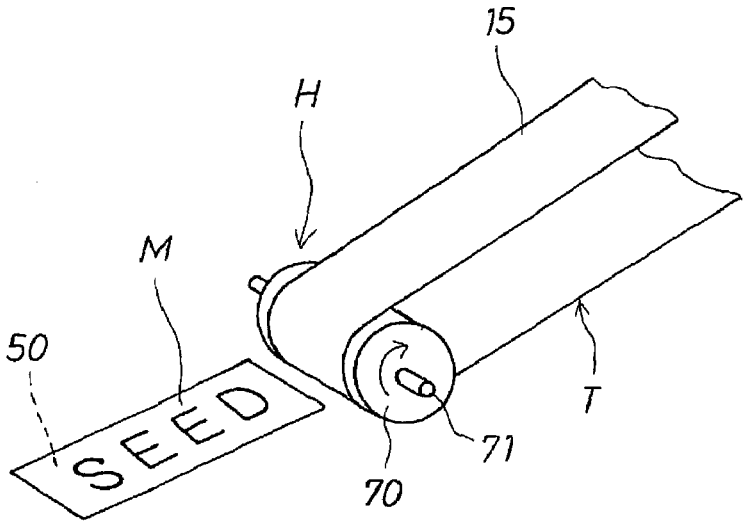
FIG. 28(*a*) is a perspective view of essential parts of transfer head of a mark transfer tool in embodiment 19 of the invention.
Figure 28B:
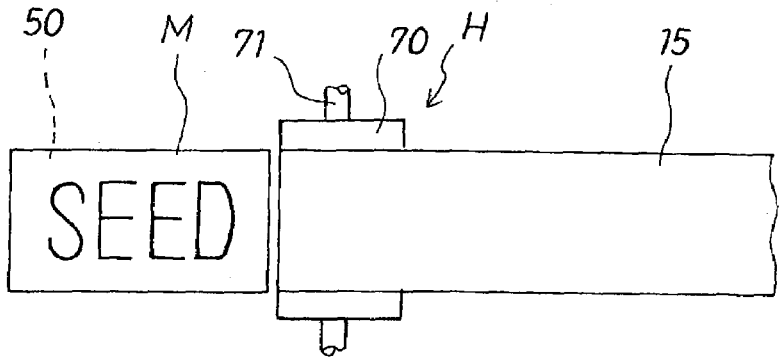
Figure 28C:
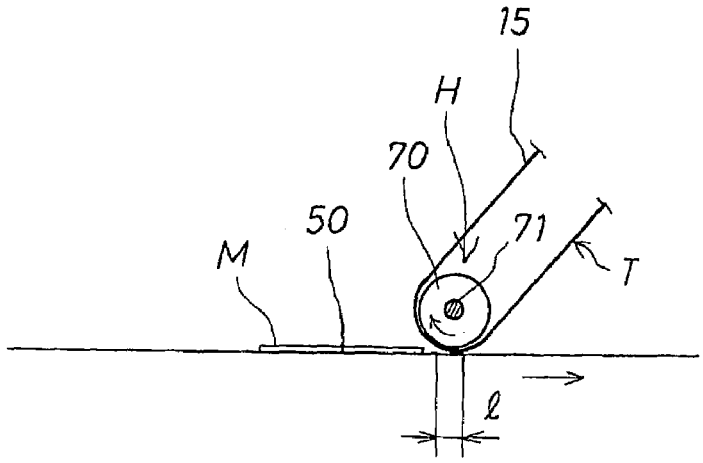

This embodiment is shown in FIG. 28(*a*) to FIG. 28(*c*), in which the structure of the transfer head H of embodiment 1 is modified.

That is, the transfer head H of the embodiment is formed like a cylindrical roller as shown in the drawing. More specifically, in this transfer head H, a cylindrical roller 70 made of an elastic material is rotatably supported through a support shaft 71, and the outer circumference of the cylindrical roller 70 is the leading end pressing portion.

Therefore, the transfer head H having such configuration is suited to a case of the transfer mark M on the mark transfer tape T having a large dimension in the longitudinal direction.

The other configuration and operation are same as in embodiment 1.

Embodiment 20

Figure 29A:
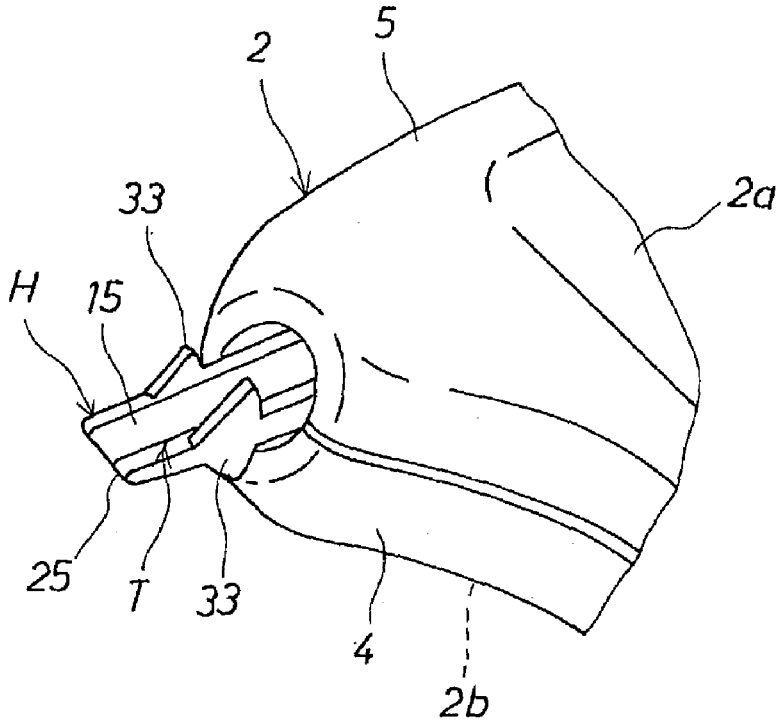
FIG. 29(*a*) is a perspective view of transfer head of a mark transfer tool in embodiment 30 of the invention, showing a lateral pulling type.
Figure 29B:
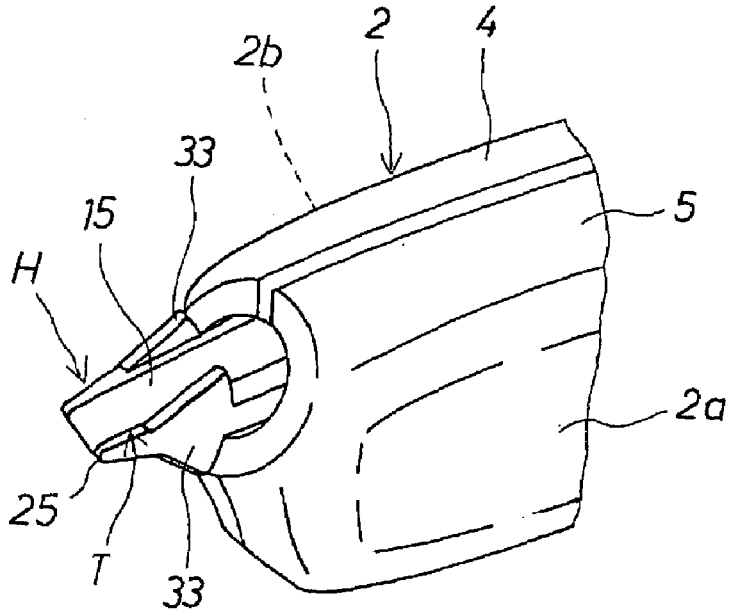

This embodiment is shown in FIG. 29(*a*) and FIG. 29(*b*), in which the structure of the transfer head H of embodiment 1 is modified.

That is, the transfer head H of the embodiment is formed as a stationary head not rotating about its axial line.

More specifically, this transfer head H is formed integrally with the case main body 4 of the case 2 and the cap body 5 as shown in the drawing. A specific structure of the transfer head H is either lateral pull type as shown in FIG. 29(*a*) in which the leading end pressing portion 25 is at an angular position for pressing the mark transfer tape T in a state parallel to the gripping surfaces 2*a*, 2*b* of the case 2, or vertical pull type as shown in FIG. 29(*b*) in which the leading end pressing portion 25*a* is at an angular position for pressing the mark transfer tape T in a state orthogonal to the gripping surfaces 2*a*, 2*b* of the case 2, which may be properly selected depending on the purpose. The other configuration and operation are same as in embodiment 1.

As described herein, the mark transfer tool of the invention is intended to transfer a transfer mark on a mark transfer tape on a sheet of paper or the like, and comprises a hand-held case, a payoff reel containing a mark transfer tape, being rotatably installed in the case, a take-up reel for collecting the used mark transfer tape, being rotatably installed in the case, and a transfer head having a leading end pressing portion for pressing the mark transfer tape being paid off from the payoff reel onto a transfer area, being disposed at the leading end of the case, in which the mark transfer tape has multiple pressure-sensitive adhesive transfer marks adhered and held at specific intervals peelably on the surface of a base tape, and the transfer marks are prepared as adhesive seals of which adhesive force of the back-side pressure sensitive adhesive layer adhered to the transfer area is set larger than the adhesive holding force on the base tape, and therefore for transferring various marks composed of characters, codes, patterns or their combination, a novel mark transfer technique completely different from the conventional mark handling techniques such as stamp impression method or mark seal adhering method can be presented, and it is effective to meet diversified needs of general users.

That is, when transferring a transfer mark on the mark transfer tape on a desired transfer area by using the mark transfer tool of the invention, only by pressing the leading end pressing portion of the transfer head tightly onto the transfer area, and moving the case directly along the sheet of paper or the like, the transfer mark is transferred, and the used mark transfer tape after peeling off the transfer mark, that is, the base tape is taken up and collected on the take-up reel.

Since the transferred transfer mark is an adhesive seal, it can be handled same as a conventional adhesive seal, and the transfer mark may be once peeled and adhered again like an adhesive seal, or peeled off and removed when no longer necessary.

When the mark is composed of a mark portion and an overwriting blank space, after transfer, it is possible to overwrite by using a writing tool on the overwriting blank space.

Exemplary embodiments presented in the detailed description of the invention above are intended to disclose the technical features of the invention, and it is to be understood that the invention is not limited to those illustrated embodiments alone but is interpreted in a wider sense of meaning, and that various changes and modifications may be effected without departing from the scope or true spirit of the invention.

What is claimed is:

1. A mark transfer tool for transferring a transfer mark on a mark transfer tape onto a sheet, comprising:

a hand-held case, a payoff reel containing a mark transfer tape, being rotatably installed in the case, a take-up reel for collecting the used mark transfer tape, being rotatably installed in the case, and a transfer head having a leading end pressing portion for pressing the mark transfer tape being paid off from the payoff reel onto a transfer area, being disposed at the leading end of the case, wherein the mark transfer tape has multiple pressure-sensitive adhesive transfer marks adhered and held at specific intervals peelably on the surface of a base tape, the transfer mark is prepared as an adhesive seal which is an integrally laminated form of a mark main body having a specified mark and a pressure-sensitive adhesive layer, the transfer mark is adhered and held on the surface of the base tape, peelably through the mark main body, and adhesive force of the pressure sensitive adhesive layer adhered to the transfer area is set larger than the adhesive holding force on the base tape.

2. The mark transfer tool of claim 1, wherein the disposing intervals of the transfer marks on the transfer tape are set larger than the pressurizing width of the leading end pressing portion of the transfer head.

3. The mark transfer tool of claim 1, wherein the step difference of the transfer marks and the base tape on the mark transfer tape composes division bodily feeling means in collaboration with the leading end pressing portion of the transfer head, and in mark transfer operation, a transfer division position of one transfer mark is felt bodily when the step difference is engaged with the leading end pressing portion of the transfer head.

4. The mark transfer tool of claim 1, wherein the transfer mark is formed of a mark only.

5. The mark transfer tool of claim 1, wherein the transfer mark is formed of a mark and an overwriting blanking space.

6. The mark transfer tool of claim 5, wherein at least the surface forming portion of the overwriting blank space of the transfer mark is made of a material allowing overwriting by writing tool.

7. The mark transfer tool of claim 5, wherein at least the surface forming portion of the overwriting blank space of the transfer mark is properly treated for allowing overwriting by writing tool.

8. The mark transfer tool of claim 5, wherein the overwriting blank space of the transfer mark is formed as a writing window penetrating through the face and back sides of the transfer mark.

9. The mark transfer tool of claim 1, wherein the transfer mark is a contact seal having the pressure-sensitive adhesive layer formed on the back side surface.

10. The mark transfer tool of claim 1, wherein the transfer mark is an index seal having the pressure-sensitive adhesive layer formed only in the leading end portion in the longitudinal direction of the back side.

11. The mark transfer tool of claim 1, wherein the transfer mark is an aromatic seal having an aromatic effect.

12. The mark transfer tool of claim 1, wherein the transfer mark is an antibacterial seal having an antibacterial effect.

13. The mark transfer tool of claim 10, wherein the pressure-sensitive adhesive layer has a property to be transferred and fixed on the transfer area, and be peeled off easily from the transfer area.

14. The mark transfer tool of claim 1, wherein the transfer head is a flexible head elastically deformable in the pressing direction of the mark transfer tape.

15. The mark transfer tool of claim 1, wherein the transfer head is a rigid head not elastically deformable in the pressing direction of the mark transfer tape.

16. The mark transfer tool of claim 1, wherein the transfer head is a pointed head having a linear leading end pressing portion for pressing the mark transfer tape on the transfer area.

17. The mark transfer tool of claim 1, wherein the transfer head is a wire head having a linear leading end pressing portion for pressing the mark transfer tape on the transfer area.

18. The mark transfer tool of claim 17, wherein a pressing cylindrical body is fitted to the linear leading end pressing portion of the wire head.

19. The mark transfer tool of claim 1, wherein the transfer head is a cylindrical roller having a cylindrical leading end pressing portion for pressing the mark transfer tape on the transfer area.

20. The mark transfer tool of claim 1, wherein the transfer head is a rotary head rotatable about its axial line.

21. The mark transfer tool of claim 1, wherein the transfer head is a fixed head not rotatable about its axial line.

22. The mark transfer tool of claim 21, wherein the transfer head is a lateral pulling head having the leading end pressing portion disposed at an angular position for pressing the mark transfer tape in a state parallel to the gripping surfaces of the case.

23. The mark transfer tool of claim 21, wherein the transfer head is a vertical pulling head having the leading end pressing portion disposed at an angular position for pressing the mark transfer tape in a state orthogonal to the gripping surfaces of the case.

24. The mark transfer tool of claim 1, wherein the tool is a refill tool including a tape cartridge comprising at least the payoff reel and take-up reel is detachably installed in the case so as to replace the mark transfer tape.

25. The mark transfer tool of claim 1, wherein the tool is a disposable tool wherein the payoff reel and take-up reel are installed in the case, and the transfer head is provided at the leading end of the case.

* * * * *